US011565903B2

(12) United States Patent
Tsuji

(10) Patent No.: US 11,565,903 B2
(45) Date of Patent: Jan. 31, 2023

(54) SHEET ALIGNMENT APPARATUS, SHEET PROCESSING APPARATUS, AND IMAGE FORMING SYSTEM

(71) Applicant: CANON KABUSHIKI KAISHA, Tokyo (JP)

(72) Inventor: Hiroharu Tsuji, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/365,247

(22) Filed: Jul. 1, 2021

(65) Prior Publication Data

US 2022/0009740 A1 Jan. 13, 2022

(30) Foreign Application Priority Data

Jul. 7, 2020 (JP) ..... JP2020-117003
Apr. 23, 2021 (JP) ..... JP2021-073269

(51) Int. Cl.
*B65H 31/34* (2006.01)
*B65H 29/52* (2006.01)

(52) U.S. Cl.
CPC ..... *B65H 29/52* (2013.01)

(58) Field of Classification Search
CPC ..... H04N 1/0066; B65H 9/04; B65H 9/10; B65H 9/101; B65H 31/34; B65H 2301/362; B65H 2408/114; B65H 2408/1144
USPC ..... 270/58.12, 58.17, 58.27
See application file for complete search history.

(56) References Cited

U.S. PATENT DOCUMENTS 6,022,011 A * 2/2000 Hirose ..... B42C 1/12 270/37
6,171,225 B1 * 1/2001 Nonoyama ..... B65H 31/3027 271/235
6,231,039 B1 * 5/2001 Chung ..... B65H 31/3018 270/58.12
6,305,681 B1 * 10/2001 Watanabe ..... B65H 37/04 270/58.08
6,450,934 B1 * 9/2002 Coombs ..... G03G 15/6541 493/383
7,052,005 B2 * 5/2006 Yamakawa ..... B65H 45/14 270/37

(Continued)

FOREIGN PATENT DOCUMENTS

JP 2016-113265 A 6/2016
JP 2017-105642 A 6/2017
JP 2020-011829 A 1/2020

*Primary Examiner* — Leslie A Nicholson, III
(74) *Attorney, Agent, or Firm* — Venable LLP

(57) ABSTRACT

A sheet alignment apparatus includes a supporting portion configured to support a sheet, a first alignment member configured to abut an end portion in a first direction of the sheet supported by the supporting portion and align a position of the sheet in the first direction, a first moving unit configured to move the first alignment member in the first direction, a second alignment member configured to abut an end portion in a second direction of the sheet supported by the supporting portion and align a position of the sheet in the second direction, the second direction being perpendicular to the first direction, and a second moving unit configured to move the second alignment member in the second direction, wherein the first moving unit is disposed below the supporting portion, and wherein the second moving unit is disposed above the supporting portion.

14 Claims, 14 Drawing Sheets

(56) References Cited

U.S. PATENT DOCUMENTS

| | | | | |
|---|---|---|---|---|
| 7,697,883 | B2 | 4/2010 | Ogata et al. | |
| 7,850,161 | B2 | 12/2010 | Fukatsu et al. | |
| 7,963,523 | B2 | 6/2011 | Koshimura et al. | |
| 8,162,306 | B2 * | 4/2012 | Suzuki | B65H 31/34 271/193 |
| 8,170,463 | B2 | 5/2012 | Ogata et al. | |
| 8,360,421 | B2 | 1/2013 | Tsuji et al. | |
| 9,586,781 | B2 * | 3/2017 | Sekigawa | B65G 37/00 |
| 10,233,048 | B2 * | 3/2019 | Noso | B65H 31/02 |
| 11,001,467 | B2 | 5/2021 | Hanamoto | |
| 2003/0193125 | A1 * | 10/2003 | Saegusa | B65H 37/04 270/58.08 |
| 2020/0207567 | A1 * | 7/2020 | Uchibori | B65H 31/3018 |
| 2020/0387101 | A1 | 12/2020 | Koyama et al. | |

* cited by examiner

SHEET ALIGNMENT APPARATUS, SHEET PROCESSING APPARATUS, AND IMAGE FORMING SYSTEM

BACKGROUND OF THE INVENTION

Field of the Invention

The present invention relates to a sheet alignment apparatus that aligns sheets, a sheet processing apparatus that processes a sheet, and an image forming system that forms an image on a sheet.

Description of the Related Art

As an optional device to an image forming apparatus such as a copier or a printer, a sheet processing apparatus that performs post-processing such as a binding process on sheets having undergone image formation is known. A binding processing apparatus disclosed in Japanese Patent Laid-Open No. 2017-105642 aligns sheets supported on a processing tray by a pair of side alignment members, performs a binding process on the aligned sheets, and then discharges the bound sheets from the processing tray by claw-shaped discharging members attached to a rotating belt.

SUMMARY OF THE INVENTION

The present invention provides a new form of a sheet alignment apparatus and an image forming apparatus.

According to one aspect of the invention, a sheet alignment apparatus includes a supporting portion configured to support a sheet, a first alignment member configured to abut an end portion in a first direction of the sheet supported by the supporting portion and align a position of the sheet in the first direction, a first moving unit configured to move the first alignment member in the first direction, a second alignment member configured to abut an end portion in a second direction of the sheet supported by the supporting portion and align a position of the sheet in the second direction, the second direction being perpendicular to the first direction, and a second moving unit configured to move the second alignment member in the second direction, wherein the first moving unit is disposed below the supporting portion, and wherein the second moving unit is disposed above the supporting portion.

According to another aspect of the invention, a sheet alignment apparatus includes a supporting portion configured to support a sheet, a reference member configured to abut an end portion in a predetermined direction of the sheet supported by the supporting portion, a moving unit configured to move the reference member in the predetermined direction, and a moving member configured to abut an upper surface of the sheet on the supporting portion and move the sheet such that the end portion of the sheet in the predetermined direction abuts the reference member, the moving member being configured to move in the predetermined direction while maintaining a certain distance between the moving member and the reference member in the predetermined direction.

According to still another aspect of the invention, a sheet alignment apparatus includes a supporting portion configured to support a sheet, an alignment member configured to abut an end portion in a first direction of the sheet supported by the supporting portion and align a position of the sheet in the first direction, a first moving unit configured to move the alignment member in the first direction, a push-out member configured to abut an end portion of the sheet in a second direction perpendicular to the first direction and push out the sheet from the supporting portion in the second direction, and a second moving unit configured to move the push-out member in the second direction, wherein one of the first moving unit and the second moving unit is disposed below the supporting portion, and wherein another of the first moving unit and the second moving unit is disposed above the supporting portion.

According to still another aspect of the invention, a sheet alignment apparatus includes a supporting portion configured to support a sheet, an upper unit provided above the supporting portion and configured to move between a first position opposing the supporting portion and a second position upwardly away from the supporting portion, and an alignment member provided in the upper unit and configured to abut an end portion of the sheet supported by the supporting portion in a state in which the upper unit is at the first position and align a position of the sheet, wherein the alignment member is configured to relatively move between a third position and a fourth position with respect to the upper unit, wherein in a case where the upper unit is at the first position and the alignment member is at the third position with respect to the upper unit, a lower end of the alignment member is positioned below a sheet supporting surface of the supporting portion on which the sheet is supported, wherein in a case where the upper unit is at the second position and the alignment member is at the third position with respect to the upper unit, the lower end of the alignment member is upwardly away from the sheet supporting surface of the supporting portion, and wherein in a course of movement of the upper unit from the second position to the first position, the lower end of the alignment member is capable of remaining above the sheet supporting surface of the supporting portion by the alignment member relatively moving from the third position to the fourth position with respect to the upper unit.

According to still another aspect of the invention, a sheet alignment apparatus includes a supporting portion configured to support a sheet, an upper unit provided above the supporting portion and configured to move between a first position opposing the supporting portion and a second position upwardly away from the supporting portion, an alignment member provided on the upper unit and configured to abut an end portion of the sheet supported by the supporting portion in a state in which the upper unit is at the first position and align a position of the sheet, and an operation portion configured to be gripped and operated to move the upper unit between the first position and the second position, wherein in a case where the upper unit is at the first position, a lower end of the alignment member is positioned below a sheet supporting surface of the supporting portion on which the sheet is supported, wherein in a case where the upper unit is at the second position, the lower end of the alignment member is upwardly away from the sheet supporting surface of the supporting portion, wherein the operation portion is detachably engaged with the upper unit, and wherein in a case where the operation portion is operated toward the first position in the state in which the upper unit is at the second position and in which the alignment member abuts an obstacle present on the supporting portion, the operation portion is detached from the upper unit, and the upper unit remains at a position between the first position and the second position.

Further features of the present invention will become apparent from the following description of exemplary embodiments with reference to the attached drawings.

DESCRIPTION OF THE EMBODIMENTS

Embodiments of the present disclosure will be described below with reference to drawings.

First Embodiment

Figure 1:
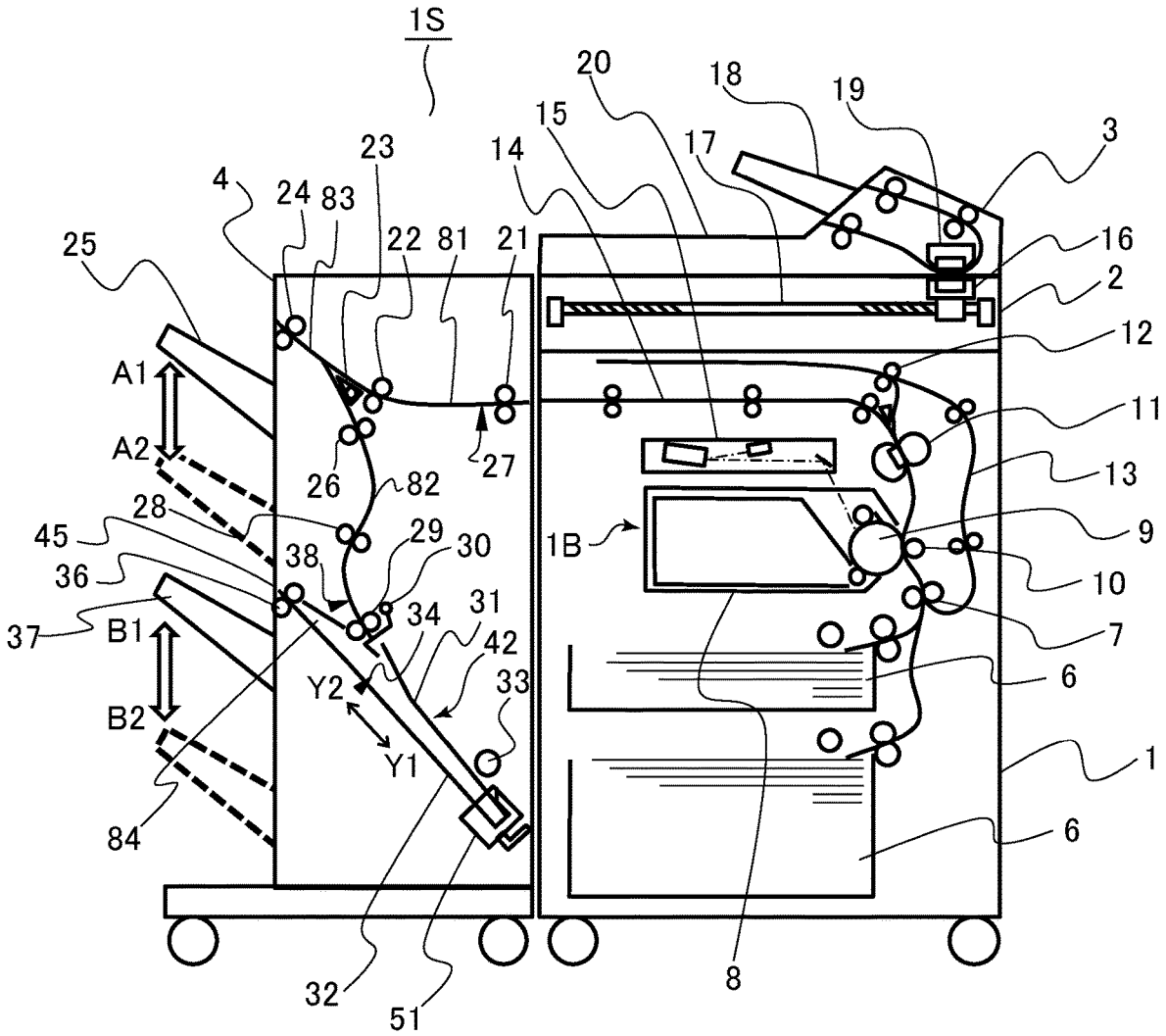
FIG. 1 is a schematic view of a post-processing apparatus and an image forming apparatus according to a first embodiment.

FIG. 1 is a schematic view of an image forming system 1S according to a first embodiment. The image forming system 1S of the present embodiment is constituted by an image forming apparatus 1, an image reading apparatus 2, a document feeding apparatus 3, and a post-processing apparatus 4. The image forming system 1S forms images on sheets serving as recording materials, and outputs the sheets after processing the sheets by the post-processing apparatus 4 if necessary. In the description below, simple description of the operation of each apparatus will be given, and then the post-processing apparatus 4 will be described in detail.

The document feeding apparatus 3 conveys a document placed on a document tray 18 to image reading portions 16 and 19. The image reading portions 16 and 19 are each an image sensor that reads image information from a document surface, and both surfaces of the document are read in one time of document conveyance. The document whose image information has been read is discharged onto a document discharge portion 20. In addition, the image reading apparatus 2 can read image information from a still document set on a platen glass by reciprocating the image reading portion 16 by a driving device 17. Examples of the still document include documents not compatible with the document feeding apparatus 3 such as booklet documents.

The image forming apparatus 1 is an electrophotographic apparatus including an image forming portion 1B of a direct transfer system. The image forming portion 1B includes a cartridge 8 including a photosensitive drum 9, and a laser scanner unit 15 disposed above the cartridge 8. In the case of performing an image forming operation, the surface of the photosensitive drum 9 that is rotating is charged, and the laser scanner unit 15 exposes the photosensitive drum 9 on the basis of image information to draw an electrostatic latent image on the surface of the photosensitive drum 9. The electrostatic latent image borne on the photosensitive drum 9 is developed into a toner image with charged toner particles, and the toner image is conveyed to a transfer portion where the photosensitive drum 9 and a transfer roller 10 oppose each other. A controller of the image forming apparatus 1 serving as a printer controller executes an image forming operation by the image forming portion 1B on the basis of image information read by the image reading portions 16 and 19 or image information received from an external computer via a network.

The image forming apparatus 1 includes a plurality of feeding apparatuses 6 that each feed a plurality of sheets serving as recording materials one by one at predetermined intervals. Examples of sheets that can be used as the recording materials include various sheets of different sizes and materials. Examples of the various sheets include paper sheets such as plain paper sheets and cardboards, plastic films, cloths, surface-treated sheet materials such as coated paper sheets, and sheet materials of irregular shapes such as envelops and index sheets. A sheet fed from a feeding apparatus 6 is conveyed to registration rollers 7, the skew thereof is corrected by the registration rollers 7, then the sheet is conveyed to the transfer portion, and the toner image borne on the photosensitive drum 9 is transferred onto the sheet in the transfer portion. A fixing unit 11 is disposed downstream of the transfer portion in the sheet conveyance direction. The fixing unit 11 includes a rotary member pair that nips and conveys the sheet, and a heat generation member such as a halogen lamp for heating the toner image, and performs a fixing process of the toner image by heating and pressurizing the toner image on the sheet.

In the case of discharging the sheet on which an image has been formed to the outside of the image forming apparatus 1, the sheet having passed through the fixing unit 11 is conveyed to the post-processing apparatus 4 through a horizontal conveyance portion 14. In the case of a sheet on a first surface of which an image has been formed in duplex printing, the sheet having passed through the fixing unit 11 is passed onto reverse conveyance rollers 12, is switched back and conveyed by the reverse conveyance rollers 12, and is then conveyed to the registration rollers 7 again through a reconveyance portion 13. Then, the sheet passes through the transfer portion and the fixing unit 11 again, thus an image is formed on a second surface thereof, and then the sheet is conveyed to the post-processing apparatus 4 through the horizontal conveyance portion 14.

The image forming portion 1B described above is an example of an image forming unit that forms an image on a sheet, and an electrophotographic unit of an intermediate transfer system that transfers a toner image formed on a photosensitive member onto a sheet via an intermediate transfer member may be used as the image forming unit. In addition, a printing unit of an inkjet system or an offset printing system may be used as the image forming unit.

Post-Processing Apparatus

The post-processing apparatus 4 includes an intermediate supporting portion 42 that temporarily supports sheets to perform processing such as a binding process on the sheets, performs the binding process on the sheets received from the image forming apparatus 1, and discharges the processed sheets as a sheet bundle. In addition, the post-processing apparatus 4 can also simply discharge the sheets received from the image forming apparatus 1 without performing the binding process.

The post-processing apparatus 4 includes an inlet path 81, an in-body discharge path 82, a first discharge path 83, and a second discharge path 84 as conveyance paths for conveying sheets, and an upper discharge tray 25 and a lower discharge tray 37 as discharge destinations to discharge the sheets to. The inlet path 81 is a first conveyance path of the present embodiment in which a sheet is received and conveyed from the image forming apparatus 1, and the in-body discharge path 82 is a second conveyance path of the present embodiment in which the sheet is conveyed toward the intermediate supporting portion 42. The first discharge path 83 is a conveyance path through which the sheet is discharged onto the upper discharge tray 25, and the second discharge path 84 is a conveyance path serving as a third conveyance path through which the sheet is discharged onto the lower discharge tray 37.

Inlet rollers 21, conveyance rollers 22, and an entrance sensor 27 are disposed on the inlet path 81. Reverse conveyance rollers 24 serving as a reverse conveyance unit and a discharge unit are disposed on the first discharge path 83. In-body discharge rollers 26, intermediate conveyance rollers 28, kick-out rollers 29, and a pre-intermediate supporting sensor 38 are disposed on the in-body discharge path 82. Bundle discharge rollers 36 are disposed on the second discharge path 84. The entrance sensor 27 and the pre-intermediate supporting sensor 38 are each an example of a sheet detection unit that detects passage of a sheet at a predetermined detection position in a conveyance path in a sheet processing apparatus. As will be described later, optical sensors that detect the presence or absence of a sheet at the detection position by using light can be used as the entrance sensor 27 and the pre-intermediate supporting sensor 38.

A sheet conveyance route in the post-processing apparatus 4 will be described below. To be noted, the detailed configuration and operation of the intermediate supporting portion 42 will be described later.

The sheet discharged from the horizontal conveyance portion 14 of the image forming apparatus 1 is received by the inlet rollers 21, and conveyed toward the conveyance rollers 22 through the inlet path 81. The entrance sensor 27 detects the sheet at the detection position between the inlet rollers 21 and the conveyance rollers 22. The conveyance rollers 22 convey the sheet received from the inlet rollers 21 toward the first discharge path 83.

To be noted, the conveyance rollers 22 accelerate to a sheet conveyance speed higher than the sheet conveyance speed in the horizontal conveyance portion 14 at a predetermined timing after passage of the trailing end of the sheet is detected by the entrance sensor 27. In addition, the sheet conveyance speed of the inlet rollers 21 may be set to a value higher than that in the horizontal conveyance portion 14 such that the sheet conveyance speed is increased at the inlet rollers 21, which are positioned upstream of the conveyance rollers 22. In this case, it is preferable that a one-way clutch is provided between a conveyance roller in the horizontal conveyance portion 14 and a motor that drives the conveyance roller, and the conveyance roller freewheels in the case where the sheet is pulled by the inlet rollers 21.

In the case where the discharge destination of the sheet is the upper discharge tray 25, the reverse conveyance rollers 24 serving as a discharge unit discharge the sheet received from the conveyance rollers 22 onto the upper discharge tray 25. In this case, the reverse conveyance rollers 24 decelerate to a predetermined discharge speed at a predetermined timing after the trailing end of the sheet has passed through the conveyance rollers 22.

In the case where the discharge destination of the sheet is the lower discharge tray 37, the reverse conveyance rollers 24 serving as a reverse conveyance unit switch back the sheet received from the conveyance rollers 22 and convey the sheet to the in-body discharge path 82. Anon-return flap 23 is disposed in a branching portion which is positioned upstream of the reverse conveyance rollers 24 in a sheet discharge direction of the reverse conveyance rollers 24 and in which the inlet path 81 and the in-body discharge path 82 branch from the first discharge path 83. The non-return flap 23 has a function of suppressing the sheet switched back by the reverse conveyance rollers 24 moving back into the inlet path 81.

The in-body discharge rollers 26, the intermediate conveyance rollers 28, and the kick-out rollers 29 that are disposed in the in-body discharge path 82 sequentially pass the sheet received from the reverse conveyance rollers 24 onto each other and convey the sheet toward the intermediate supporting portion 42. The pre-intermediate supporting sensor 38 detects the sheet at a position between the intermediate conveyance rollers 28 and the kick-out rollers 29.

The intermediate supporting portion 42 supports sheets thereon, and includes a stapler 51 serving as a processing unit of the present embodiment. Sheets discharged from the kick-out rollers 29 are stacked on the intermediate supporting portion 42 constituted by an intermediate supporting plate 32, an intermediate upper guide 31, and so forth, and are subjected to an alignment process by a longitudinal alignment roller 33 or the like that will be described later. In addition, a bundle pressing flag 30 that suppresses lift-up of the trailing end of a sheet is rotatably supported at a position downstream of the kick-out rollers 29 such that the trailing end of a sheet supported on the intermediate supporting plate 32 does not interfere with the leading end of a subsequent sheet. Further, a sheet presence/absence sensor 34 that detects the presence or absence of a sheet on the supporting surface of the intermediate supporting plate 32 is disposed below the intermediate supporting plate 32.

After a plurality of sheets discharged from the in-body discharge path 82 one by one are received by the intermediate supporting portion 42 and aligned, predetermined positions of the plurality of sheets are stapled by the stapler 51, and thus the plurality of sheets are bound as a sheet bundle. The detailed configuration and operation of the intermediate supporting portion 42 will be described later. The sheet bundle bound together in the intermediate supporting portion 42 is passed onto bundle discharge rollers 36 through the second discharge path 84 serving as a third conveyance path, and is discharged onto the lower discharge tray 37 by the bundle discharge rollers 36 serving as a discharge unit. That is, the post-processing apparatus 4 includes a discharge portion that is an opening portion for discharging the sheets conveyed in the discharge direction by the bundle discharge rollers 36 from the inside to the outside of the apparatus.

The upper discharge tray 25 and the lower discharge tray 37 are both capable of moving up and down with respect to the casing (i.e., main body) of the post-processing apparatus 4. The post-processing apparatus 4 includes sheet surface detection sensors that respectively detect the upper surface positions, that is, sheet stacking heights of sheets on the upper discharge tray 25 and the lower discharge tray 37, and if one of the sensors detects a sheet, the corresponding tray is moved down in an A2 direction or a B2 direction. In addition, when removal of sheets from the upper discharge tray 25 or the lower discharge tray 37 is detected by a sheet surface detection sensor, the corresponding tray is moved up in an A1 direction or a B1 direction. Therefore, the ascent and descent of the upper discharge tray 25 and the lower discharge tray 37 are controlled in accordance with the amount of sheets supported thereon such that the upper surface of the sheets supported thereon is maintained at a constant height. In the present embodiment, although the ascent and descent of each of the upper discharge tray 25 serving as a first supporting portion and the lower discharge tray 37 serving as a second supporting portion are controlled by being driven by a motor, the ascent and descent may be controlled by, for example, an urging member such as a spring.

To be noted, the processing unit is not limited to the stapler 51 that performs a binding process, and a processing unit that performs a different process such as a folding process or cutting process on sheets supported on the intermediate supporting portion 42 may be provided. In addition, although an operation in the case of binding an aligned sheet bundle by the stapler 51 on the intermediate supporting portion 42 will be described below, a configuration in which the aligned sheet bundle is discharged onto the lower discharge tray 37 without binding the sheet bundle may be employed.

Intermediate Supporting Portion

Figure 2:
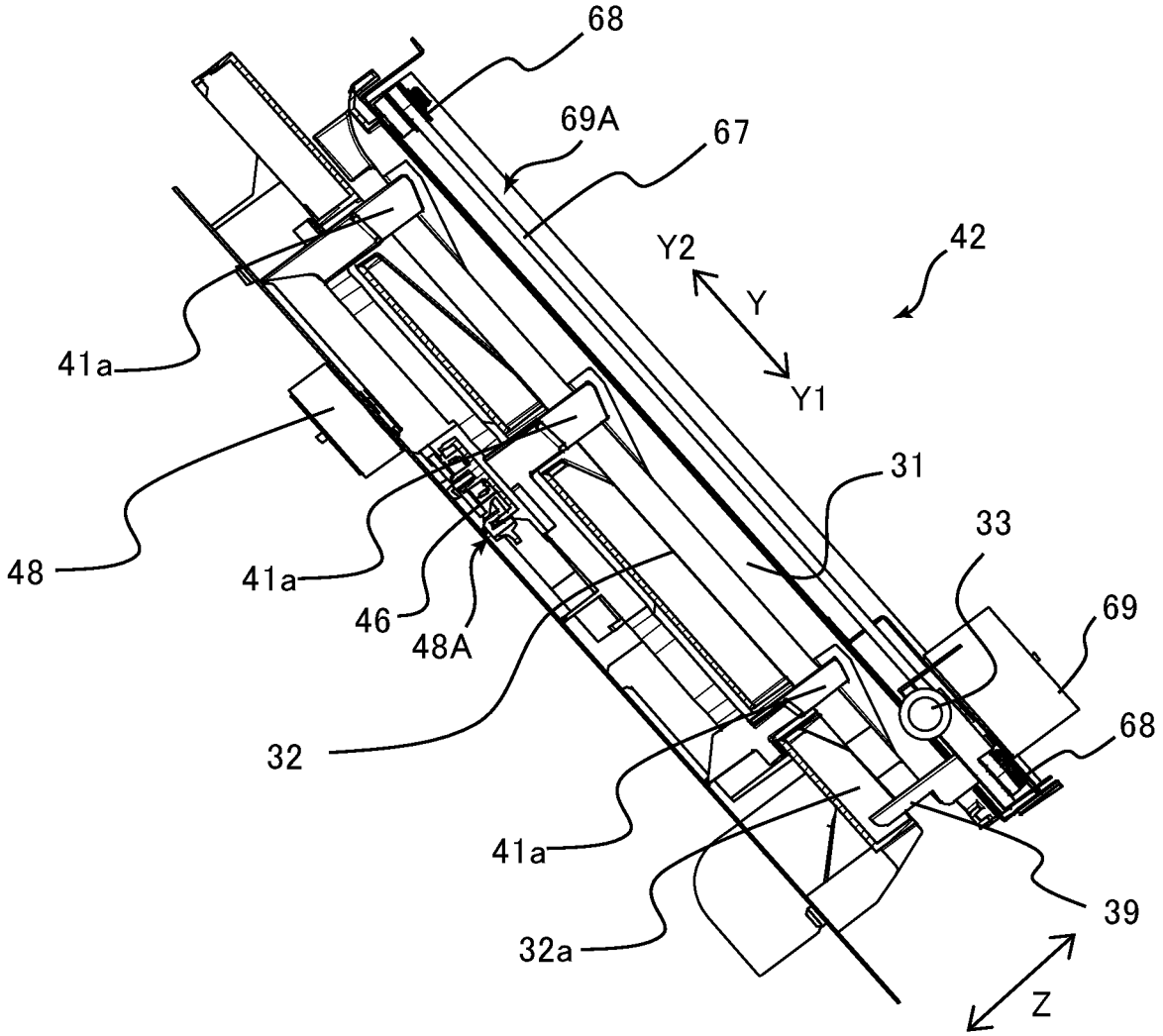
FIG. 2 is a section view of an intermediate supporting portion according to the first embodiment.
Figure 3:
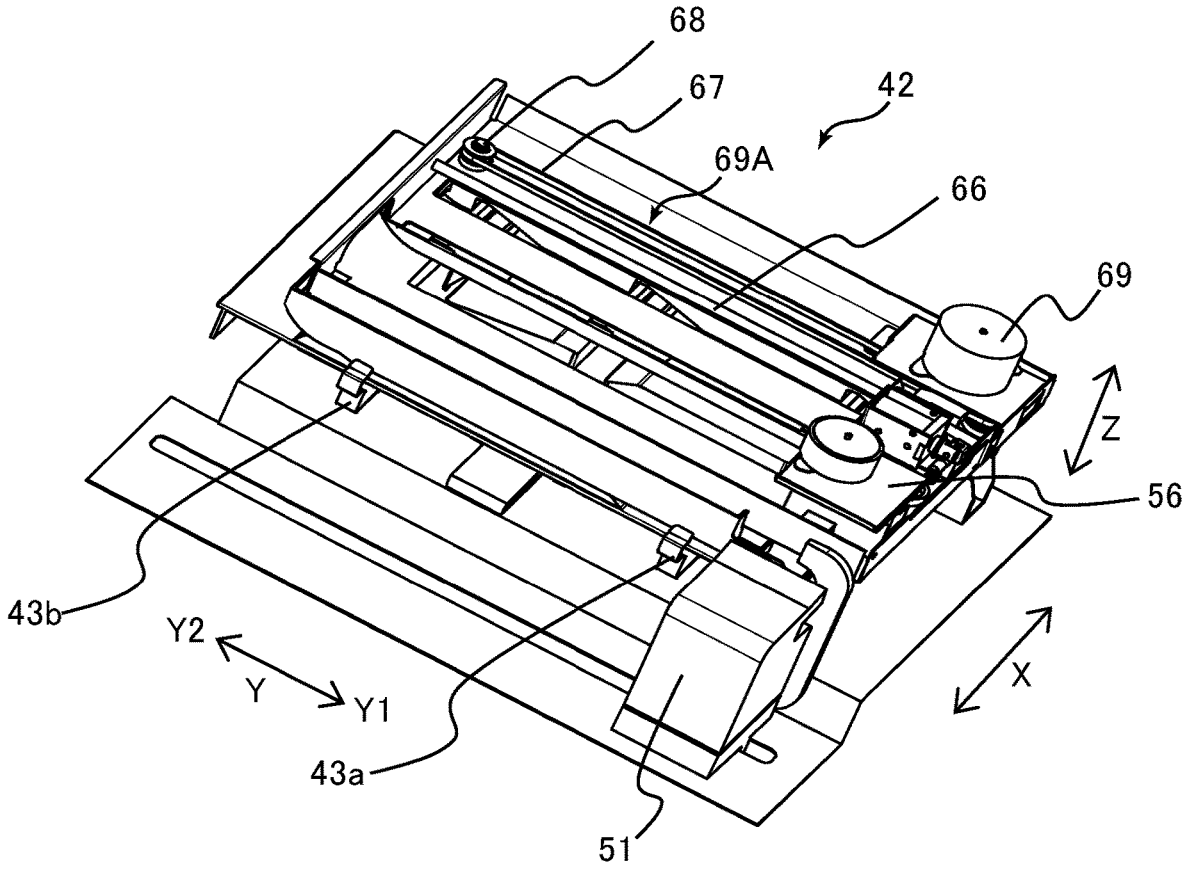
FIG. 3 is a perspective view of the intermediate supporting portion according to the first embodiment.
Figure 4:
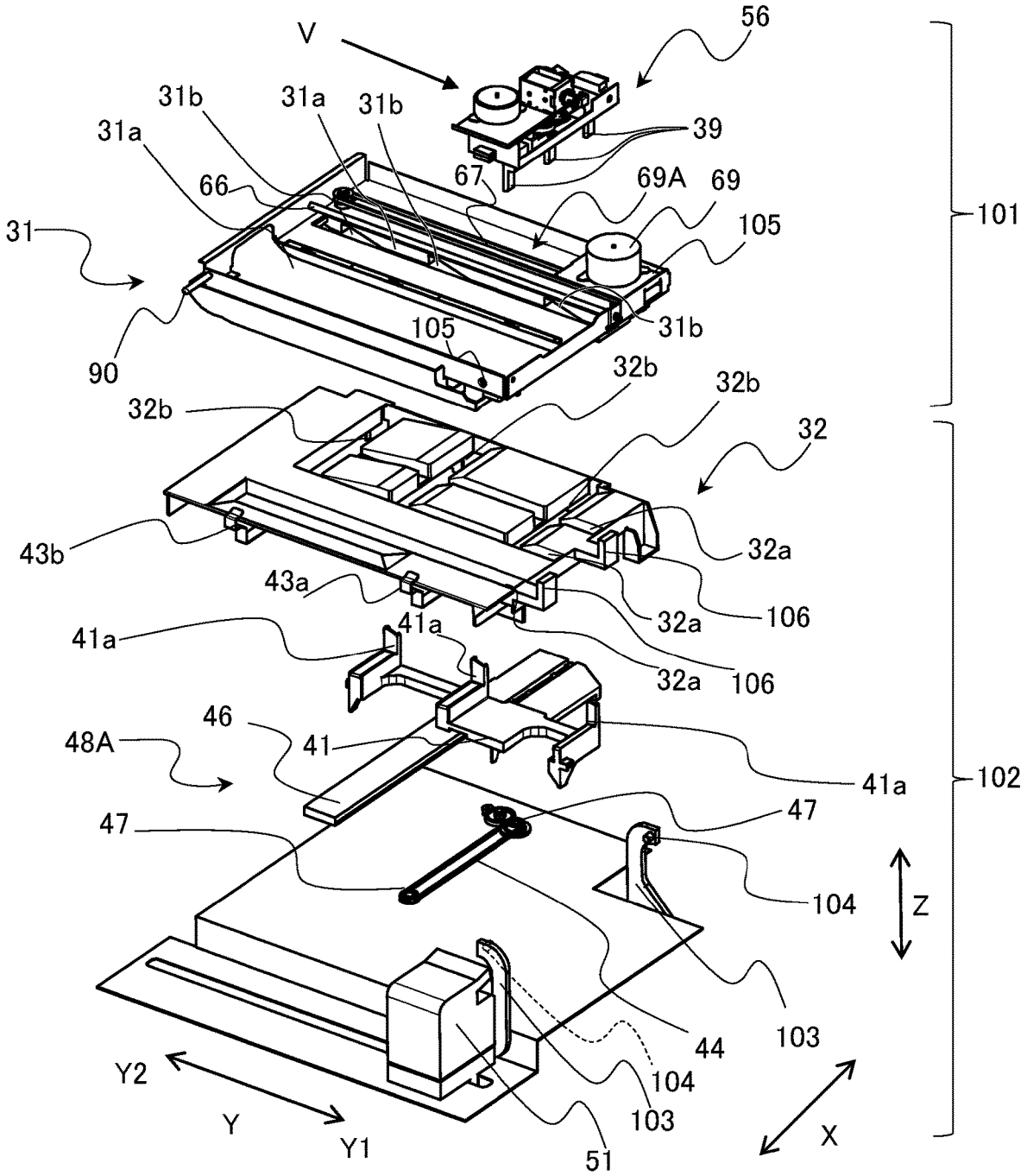
FIG. 4 is an exploded view of the intermediate supporting portion according to the first embodiment.
Figure 5:
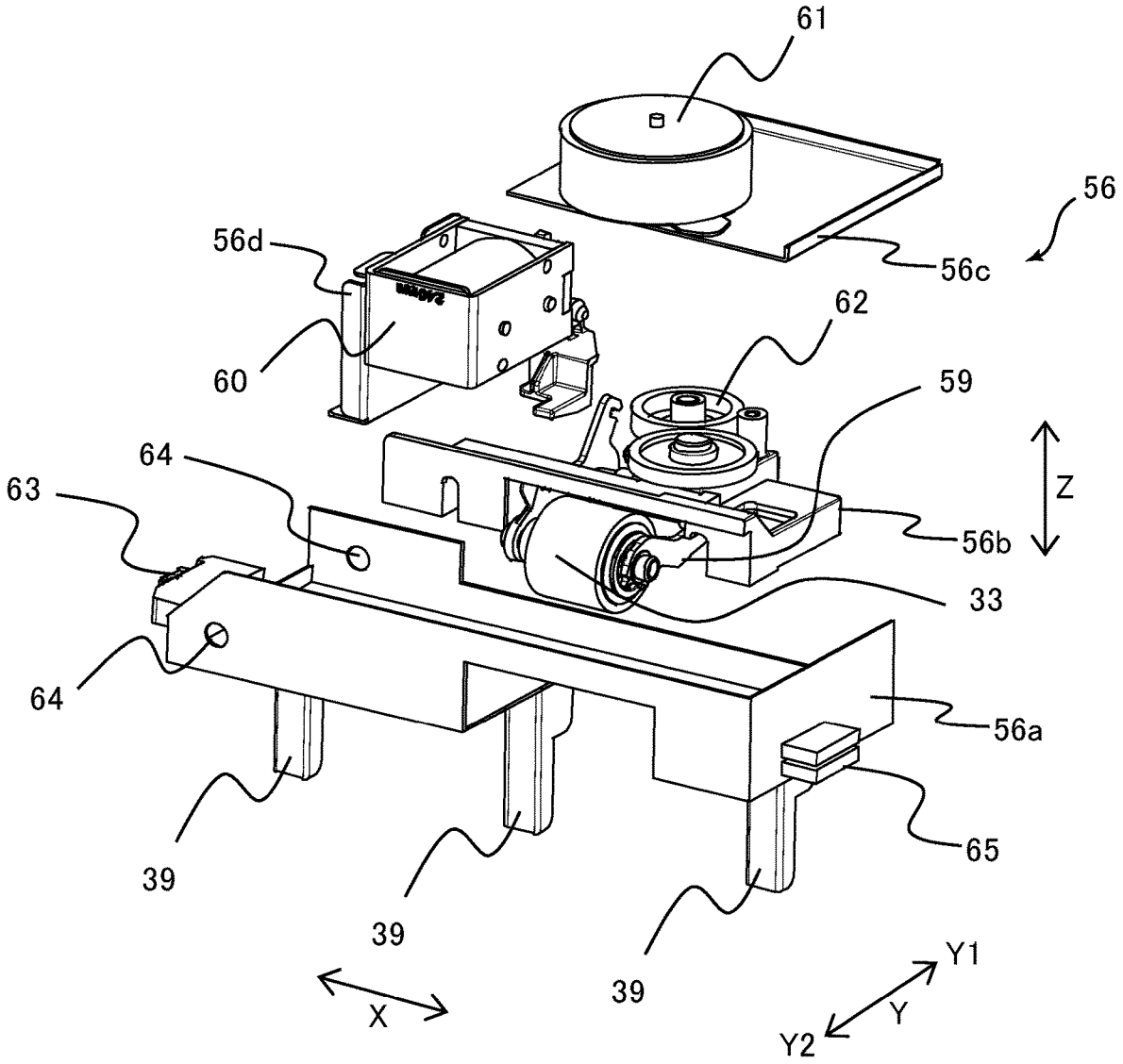
FIG. 5 is a longitudinal movement unit according to the first embodiment.

Next, a configuration of the intermediate supporting portion 42 will be described with reference to FIGS. 2 to 5. FIG. 2 is a section view of the intermediate supporting portion 42. FIG. 3 is a perspective view of the intermediate supporting portion 42. FIG. 4 is an exploded view of constituents of the intermediate supporting portion 42. FIG. 5 is an exploded view of constituents of a longitudinal movement unit 56 as viewed in a direction of an arrow V illustrated in FIG. 4, which is a conveyance direction that will be described below.

In the description below, a direction in which a sheet moves when the kick-out rollers 29 illustrated in FIG. 1 discharge the sheet onto the intermediate supporting portion 42 and when the sheet is discharged from the intermediate supporting portion 42 will be referred to as a "conveyance direction Y" or a "longitudinal direction" in the intermediate supporting portion 42. In addition, a direction perpendicular to the conveyance direction Y in a plane in which a sheet supported on the intermediate supporting portion 42 extends will be referred to as a "width direction X" or a "lateral direction" in the intermediate supporting portion 42. Further, a direction perpendicular to the conveyance direction Y and the width direction X, that is, the normal direction of the sheet supported on the intermediate supporting portion 42 will be referred to as a "thickness direction Z" of sheets on the intermediate supporting portion 42. The conveyance direction Y serves as a first direction of the present embodiment, the width direction X serves as an example of a second direction perpendicular to the first direction, and the thickness direction Z serves as an example of a third direction perpendicular to the first direction and the second direction.

As illustrated in FIGS. 2 to 4, the intermediate supporting portion 42 includes the intermediate supporting plate 32, the intermediate upper guide 31, longitudinal alignment reference plates 39, the longitudinal alignment roller 33, a lateral alignment moving member 41, lateral alignment reference plates 43*a* and 43*b*, a longitudinal movement driving portion 69A, a lateral movement driving portion 48A, and so forth. The intermediate supporting plate 32 serves as a supporting portion of the present embodiment, and the intermediate upper guide 31 serves as an opposing member of the present embodiment that opposes the supporting portion in the thickness direction Z. The lateral alignment moving member 41 serves as a first alignment member of the present embodiment, and the lateral movement driving portion 48A serves as a first moving unit of the present embodiment. The longitudinal alignment reference plates 39 serve as second alignment members of the present embodiment, and the longitudinal movement driving portion 69A serves as a second moving unit of the present embodiment. The lateral alignment reference plates 43*a* and 43*b* serve as first direction reference members of the present embodiment. In addition, the longitudinal alignment roller 33 serves as a moving member of the present embodiment.

The intermediate supporting plate 32 has a supporting surface 32*s* extending approximately in the conveyance direction Y and the width direction X as illustrated in FIG. 4, and the lower surface of the lowermost sheet of the sheet bundle supported on the intermediate supporting portion 42 is supported by the supporting surface 32*s* serving as a sheet supporting surface. That is, the intermediate supporting plate 32 functions as a supporting portion of the present embodiment. The intermediate upper guide 31 is disposed on the upper side of the intermediate supporting plate 32 in the thickness direction Z and has a lower surface extending approximately in the conveyance direction Y and the width direction X as a surface opposing the supporting surface 32*s*.

The longitudinal alignment reference plates 39 are disposed in the most downstream portion of the intermediate supporting portion 42 in the conveyance direction Y as illustrated in FIGS. 2 and 4. The longitudinal alignment reference plates 39 function as alignment members for aligning the sheet bundle supported on the intermediate supporting portion 42 by abutting an end portion of the sheets in the conveyance direction Y. As illustrated in FIG. 5, a plurality of the longitudinal alignment reference plates 39 are arranged in the width direction X. Upstream surfaces of the plurality of longitudinal alignment reference plates 39 in the conveyance direction Y function as a plurality of second abutting portions where the second alignment members abut an end portion of the sheets.

A plurality of longitudinal slide grooves 32*a* illustrated in FIG. 4 each extending in the conveyance direction Y are provided in the intermediate supporting plate 32. In addition, a plurality of longitudinal slide holes 31*a* each extending in the conveyance direction Y are provided in the intermediate upper guide 31. To be noted, whereas the longitudinal slide holes 31*a* are holes penetrating the intermediate upper guide 31 in the thickness direction Z, the longitudinal slide grooves 32*a* are recess portions recessed downward in the thickness direction Z in section view taken along a virtual plane perpendicular to the longitudinal direction, that is, the conveyance direction Y. Therefore, the intermediate supporting plate 32 can be formed as one member continuous in the width direction X via the bottom of the longitudinal slide grooves 32*a*. The longitudinal slide grooves 32*a* serve as first grooves of the present embodiment, and the longitudinal slide holes 31*a* serve as second holes of the present embodiment.

The longitudinal alignment reference plates 39 extend downward penetrating through the longitudinal slide holes 31*a* of the intermediate upper guide 31, and the distal end portions of the longitudinal alignment reference plates 39 extend to regions inside the longitudinal slide grooves 32*a* of the intermediate supporting plate 32. In other words, in the present embodiment, the second alignment members extend to the regions inside the first grooves through the second holes. That is, the distal ends of the longitudinal alignment reference plates 39 are positioned below the supporting surface 32*s* of the intermediate supporting plate 32 in the thickness direction Z as illustrated in FIG. 2, and the longitudinal alignment reference plates 39 overlap with the intermediate supporting plate 32 in the thickness direction Z. The longitudinal alignment reference plates 39 are capable of reciprocating in the conveyance direction Y along the longitudinal slide holes 31*a* and the longitudinal slide grooves 32*a*.

The longitudinal alignment reference plates 39 are provided as a part of the longitudinal movement unit 56 illustrated in FIGS. 4 and 5 driven by the longitudinal movement driving portion 69A that will be described later. The longitudinal movement unit 56 is a movable unit movable in the conveyance direction Y, that is, the longitudinal direction. As illustrated in FIG. 5, the longitudinal movement unit 56 includes the plurality of longitudinal alignment reference plates 39, the longitudinal alignment roller 33, a solenoid 60, a roller driving motor 61, and support plates 56*a*, 56*b*, 56*c*, and 56*d*. The support plates 56*a* to 56*d* are fixed together by screws or the like to form a frame member of the longitudinal movement unit 56, and support other constituents of the longitudinal movement unit 56.

The longitudinal alignment roller 33 is supported by a roller holder 59, and is rotatable about a rotation axis extending in the width direction X. The roller holder 59 is attached to the support plate 56*b* to be swingable about an unillustrated fulcrum. The roller holder 59 is connected to the solenoid 60 via an unillustrated link mechanism, and the roller holder 59 swings via the link mechanism by supplying power to the solenoid 60. For example, when power is supplied to the solenoid 60, the roller holder 59 pivots downward, and when power supply to the solenoid 60 is stopped, the roller holder 59 pivots upward. That is, the longitudinal alignment roller 33 swings between an upper position in which the longitudinal alignment roller 33 is retracted from the sheets supported on the intermediate supporting plate 32 and a lower position in which the longitudinal alignment roller 33 abuts the supported sheets such that conveyance force can be applied to the sheets, in accordance with whether or not power is supplied to the solenoid 60.

The roller driving motor 61 is connected to the longitudinal alignment roller 33 via a gear train 62, and rotationally drives the longitudinal alignment roller 33. That is, when the roller driving motor 61 rotates in a state in which the longitudinal alignment roller 33 is at the lower position, the longitudinal alignment roller 33 rotates so as to move the uppermost sheet on the intermediate supporting plate 32 toward a first side in the conveyance direction Y, that is, in a longitudinal alignment direction Y1 to cause the uppermost sheet to abut the longitudinal alignment reference plates 39.

Here, a configuration of the longitudinal movement driving portion 69A for reciprocating the longitudinal movement unit 56 in the conveyance direction Y will be described. As illustrated in FIG. 3, the longitudinal movement driving portion 69A includes a rail shaft 66, a timing belt 67, a pulley pair 68, and an unillustrated rail, and is disposed in an upper portion of the intermediate supporting portion 42, that is, above the intermediate upper guide 31. The longitudinal movement driving portion 69A moves the longitudinal movement unit 56 by a driving force supplied from the longitudinal movement motor 69 serving as a drive source.

As illustrated in FIG. 5, the longitudinal movement unit 56 includes a timing belt gripping portion 63, a pair of rail bearing holes 64, and a rail gripping portion 65. The rail bearing holes 64 and the rail gripping portion 65 are preferably respectively provided on the first side and the second side of the longitudinal movement unit 56 in the width direction X as illustrated in FIG. 5.

The longitudinal movement unit 56 is attached such that the rail shaft 66 penetrate through the pair of rail bearing holes 64 on the first side in the width direction X, and the rail gripping portion 65 grips the rail of the intermediate upper guide 31 on the second side in the width direction X. The rail shaft 66 extends in the conveyance direction Y, and the unillustrated rail is provided on the intermediate upper guide 31 and extends in the conveyance direction Y. The rail bearing holes 64 and the rail gripping portion 65 each function as a guided portion guided in the conveyance direction Y by the rail shaft 66 and the rail serving as guiding portions.

The timing belt gripping portion 63 grips the timing belt 67, and thus the longitudinal movement unit 56 is attached to the timing belt 67. The timing belt 67 is stretched by the pulley pair 68 arranged apart from each other in the conveyance direction Y as illustrated in FIG. 2. The pulley pair 68 is connected to the longitudinal movement motor 69 via an unillustrated drive train. Therefore, the timing belt 67 is driven via the pulley pair 68 by normal rotation and reverse rotation of the longitudinal movement motor 69, and thus the longitudinal movement unit 56 moves toward the first side and the second side in the conveyance direction Y.

As illustrated in FIG. 4, a lateral alignment moving member 41 is provided below the intermediate supporting plate 32 for aligning the sheets in the width direction X. The lateral alignment moving member 41 is also referred to as a lateral alignment jogger or a width direction alignment member. The lateral alignment moving member 41 abuts an end portion of the sheets in a second direction perpendicular to the first direction, and thus functions as a first alignment member that aligns the position of the sheets in the first direction on the intermediate supporting portion 42.

The lateral alignment moving member 41 has a plurality of side end pressing surfaces 41*a* extending in the conveyance direction Y and the thickness direction Z as a plurality of first abutting portions that abut a side end portion of the sheets in the width direction X. A plurality of lateral slide holes 32*b* each extending in the width direction X are defined in the intermediate supporting plate 32. In addition, a plurality of lateral slide grooves 31*b* each extending in the width direction X are defined in the intermediate upper guide 31. To be noted, whereas the lateral slide holes 32*b* are holes penetrating the intermediate supporting plate 32 in the thickness direction Z, the lateral slide grooves 31*b* are recess portions opening upward in the thickness direction Z in section view taken along a virtual plane perpendicular to the longitudinal direction, that is, the width direction x. Therefore, the intermediate upper guide 31 can be formed as a single member continuous in the conveyance direction Y via the bottom portion of the lateral slide grooves 31*b*. The lateral slide grooves 31*b* serve as second grooves of the present embodiment, and the lateral slide holes 32*b* serve as first holes of the present embodiment.

The side end pressing surfaces 41*a* extend upward through the lateral slide holes 32*b* of the intermediate supporting plate 32, and distal ends, that is, upper ends of the side end pressing surfaces 41*a* extend to regions inside the lateral slide grooves 31*b* of the intermediate upper guide 31. In other words, in the present embodiment, the first alignment members extend to regions inside the second grooves through the first holes. That is, the distal ends of the side end pressing surfaces 41*a* of the lateral alignment moving member 41 are positioned above the lower surface of the intermediate upper guide 31 in the thickness direction Z, and the side end pressing surfaces 41*a* overlap with the intermediate upper guide 31 in the thickness direction Z.

The lateral alignment moving member 41 is configured to be moved in the width direction X by the lateral movement driving portion 48A. The lateral movement driving portion 48A includes a timing belt 44, a pulley pair 47, and a rail 46, and moves the lateral alignment moving member 41 by a driving force supplied from the lateral movement motor 48. The lateral alignment moving member 41 includes an engagement portion that engages with the timing belt 44, and a guided portion that engages with the rail 46 serving as a guiding portion extending in the width direction X. The timing belt 44 is stretched by the pulley pair 47 arranged apart from each other in the width direction X, and the pulley pair 47 is connected to the lateral movement motor 48 illustrated in FIG. 2 via a gear train. Therefore, the timing belt 44 is driven via the pulley pair 47 by normal rotation and reverse rotation of the lateral movement motor 48, and thus the lateral alignment moving member 41 is guided by the rail 46 and reciprocates between the first side and the second side in the width direction X. In accordance with this, the side end pressing surfaces 41*a* reciprocate in the width direction X along the lateral slide grooves 31*b* and the lateral slide holes 32*b* provided in the intermediate supporting plate 32 and the intermediate upper guide 31.

As described above, in the present embodiment, the rail shaft 66, the timing belt 67, and so forth constituting the longitudinal movement driving portion 69A are disposed above the distal ends of the side end pressing surfaces 41*a* of the lateral alignment moving member 41. In other words, in the thickness direction Z, the lateral movement driving portion 48A is disposed above a movement trajectory of the lateral alignment moving member 41 moving in the width direction X. In addition, the rail 46, the timing belt 44, and so forth constituting the lateral movement driving portion 48A are disposed below the lower end positions of the longitudinal alignment reference plates 39. In other words, in the thickness direction Z, the longitudinal movement driving portion 69A is disposed below a movement trajectory of the longitudinal alignment reference plates 39 moving in the conveyance direction Y.

As illustrated in FIGS. 3 and 4, the lateral alignment reference plates 43*a* and 43*b* are disposed to oppose the side end pressing surfaces 41*a* of the lateral alignment moving member 41 in the width direction X. The lateral alignment reference plates 43*a* and 43*b* are members that do not move in the alignment operation in the width direction X, and the sheets are aligned by being pressed against the lateral alignment reference plates 43*a* and 43*b* by the lateral alignment moving member 41 moving in the X direction. The lateral alignment reference plates 43*a* and 43*b* of the present embodiment are attached to the intermediate supporting plate 32, and extend to positions higher than the supporting surface 32*s* of the intermediate supporting plate 32 as viewed in the width direction X.

To be noted, in the present embodiment, one of the lateral alignment reference plates 43*a* and 43*b*, which is the lateral alignment reference plate 43*a* provided on the downstream side in the longitudinal alignment direction Y1 in the present embodiment, is configured such that the position thereof in the conveyance direction Y can be adjusted by an unillustrated driving unit. To be noted, both the lateral alignment reference plates 43*a* and 43*b* may be provided as fixed members.

Here, as illustrated in FIG. 4, the longitudinal slide grooves 32*a* and the lateral slide holes 32*b* provided in the intermediate supporting plate 32 intersect with each other in the plane of the supporting surface 32*s* as viewed in the thickness direction Z. In addition, the longitudinal slide holes 31*a* and the lateral slide grooves 31*b* provided in the intermediate upper guide 31 intersect with each other in the plane of the lower surface of the intermediate upper guide 31 as viewed in the thickness direction Z.

As illustrated in FIG. 3, the stapler 51 is provided on the front side of the apparatus with respect to the intermediate supporting portion 42, that is, on one side in the width direction X corresponding to the lower left side in FIG. 3. The stapler 51 is capable of executing a binding operation of stapling predetermined positions of the side end portion in the width direction X of a sheet bundle supported on the intermediate supporting portion 42 while being moved in the conveyance direction Y along the side end portion by an unillustrated actuator and a driving unit. To be noted, as will be described later, in the present embodiment, long-side binding in which a plurality of positions along a long side of sheets of A4 size or legal size are stapled by the stapler 51 can be executed.

As illustrated in FIG. 1, the bundle discharge rollers 36 that discharge the sheet bundle subjected to post-processing in the intermediate supporting portion 42 are provided on the opposite side to standby positions of the longitudinal alignment reference plates 39 in the conveyance direction Y, which are illustrated in FIG. 1. That is, in the present embodiment, the conveyance direction of the sheet bundle from the intermediate supporting portion 42 toward the bundle discharge rollers 36, that is, a bundle discharge direction Y2, is opposite to the conveyance direction Y1 in which the kick-out rollers 29 discharge sheets to the intermediate supporting portion 42.

Here, in the present embodiment, the longitudinal alignment reference plates 39 also function as discharge members or push-out members that push out and discharge the sheet bundle from the intermediate supporting portion 42. That is, the longitudinal alignment reference plates 39 are capable of moving the sheets to at least a position where the leading end in the bundle discharge direction Y2 of sheets of a size having the smallest length in the conveyance direction Y among sheets of sizes whose discharge destination can be set to the lower discharge tray 37 come into contact with the bundle discharge rollers 36.

Operation of Intermediate Supporting Portion

Figure 6B:
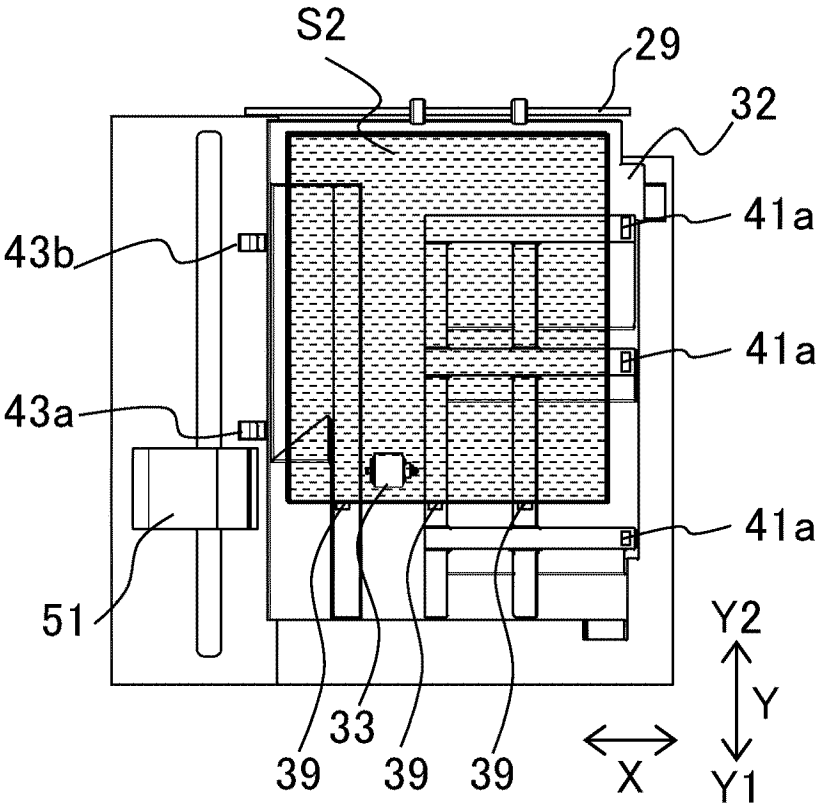
FIGS. 6A and 6B are each a diagram illustrating an example of standby positions of longitudinal alignment reference plates according to the first embodiment.
Figure 6A:
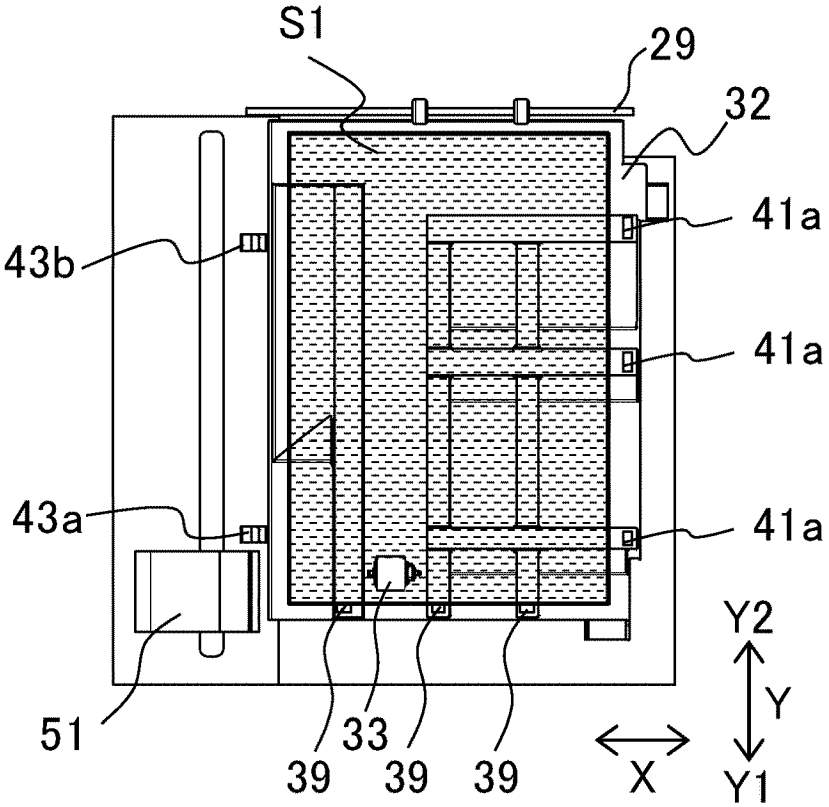

Next, the operation of the intermediate supporting portion 42 will be described. FIGS. 6A and 6B are diagrams illustrating the intermediate supporting portion 42 as viewed in the thickness direction Z, that is, in the normal direction perpendicular to the sheet surface. To be noted, only constituents that are necessary for description are illustrated. FIG. 6A illustrates a state in which a sheet S1 of a large size such as a legal size has been conveyed onto the intermediate supporting plate 32, and FIG. 6B illustrates a state in which a sheet S2 of a small size such as a letter size has been conveyed onto the intermediate supporting plate 32. To be noted, the large size and the small size indicate relative size difference. In addition, in the intermediate supporting portion 42, sheets of an A4 size that has a smaller length than the letter size and the legal size in the width direction X direction and a length smaller than that of the legal size and larger than that of the letter size in the conveyance direction Y can be also aligned and processed. The length in the width direction X will be hereinafter also referred to as a sheet width, and the length in the conveyance direction Y will be hereinafter also referred to as a sheet length.

In the present embodiment, the longitudinal movement unit 56 including the longitudinal alignment reference plates 39 and the longitudinal alignment roller 33 are moved in advance to predetermined positions, which are included in preset positions, corresponding to the sheet size such that the leading end of the sheets supported on the intermediate supporting plate 32 is at approximately the same position for every sheet size. The leading end of the sheets mentioned herein is the downstream end of the sheet bundle in the bundle discharge direction Y2 at the time of discharging the sheet bundle from the intermediate supporting portion 42, that is, the upstream end of the sheets in the longitudinal alignment direction Y1 at the time of the longitudinal alignment roller 33 causing the sheets to abut the longitudinal alignment reference plates 39. In addition, the predetermined positions are positions where the distance between a nip position of the kick-out rollers 29 and the sheet contact surfaces of the longitudinal alignment reference plates 39 is slightly larger than the sheet length of the sheets to be aligned. Therefore, the predetermined positions corresponding to the sheet S1 of the large size illustrated in FIG. 6A are upstream of the predetermined positions corresponding to the sheet S2 of the small size illustrated in FIG. 6B in the bundle discharge direction Y2. That is, the predetermined positions corresponding to the sheet S1 are downstream of the predetermined positions corresponding to the sheet S2 in the longitudinal alignment direction Y1.

In addition, when receiving sheets by the intermediate supporting portion 42, the stapler 51 and the lateral alignment reference plate 43*a* are also moved in advance to predetermined positions in the conveyance direction Y. The predetermined position of the lateral alignment reference plate 43*a* is a position where the lateral alignment reference plate 43*a* stands by when the stapler 51 performs the binding process on the sheets, and is set in advance so as not to interfere with the stapler 51. In addition, the predetermined position of the stapler 51 is a standby position for moving to the first stapling position in the binding process.

Next, the operation of the intermediate supporting portion 42 will be described in time series with reference to FIGS. 7A to 7E. Here, a series of operation of aligning the sheets S2 of the small size and performing the binding process will be described.

Figure 7A:
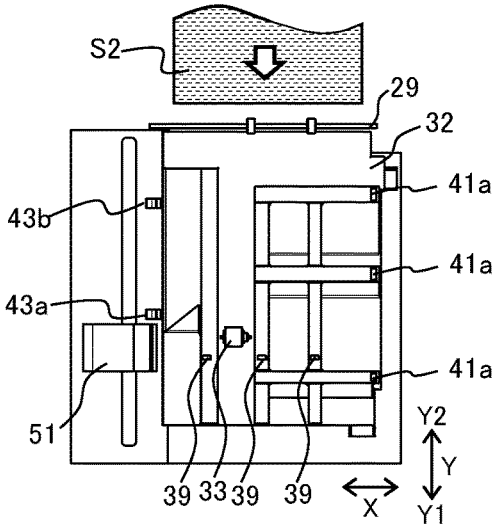
FIGS. 7A to 7E are each a diagram for describing an operation of the intermediate supporting portion according to the first embodiment.

FIG. 7A illustrates a state in which the first sheet S2 is being conveyed toward the intermediate supporting portion 42. The movement of the longitudinal movement unit 56 including the longitudinal alignment reference plates 39 and the longitudinal alignment roller 33, the stapler 51, and the lateral alignment reference plate 43*a* to the predetermined positions corresponding to the sheet size is completed before the trailing end of the sheet S2 passes through the kick-out rollers 29. The lateral alignment moving member 41 is standing by at positions slightly more on the outside than the side ends of the sheet S2 in the width direction X so as not to hinder the conveyance of the sheet S2.

Figure 7B:
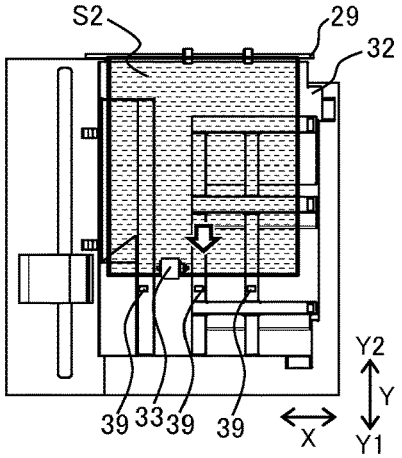

FIG. 7B illustrates a state in which the trailing end of the first sheet S2 has reached the nip of the kick-out rollers 29. At this time, the leading end of the sheet S2 in the longitudinal alignment direction Y1 has reached a position closer to the longitudinal alignment reference plates 39 than a sheet abutting position of the longitudinal alignment roller 33. In response to power supply to the solenoid 60, the longitudinal alignment roller 33 descends and abuts the upper surface of the sheet S2, and thus performs a longitudinal alignment operation, that is, an alignment operation in the conveyance direction Y, of moving the sheet S2 in the longitudinal alignment direction Y1 by driving the roller driving motor 61. As a result of this, the leading end of the sheets S2 in the longitudinal alignment direction Y1 abuts the longitudinal alignment reference plates 39, and thus the positions of sheets S2 in the conveyance direction Y are aligned in accordance with the longitudinal alignment reference plates 39. To be noted, the timing at which the longitudinal alignment roller 33 is lowered may be after or before the passage of the leading end of the sheet S2 through the sheet abutting position of the longitudinal alignment roller 33.

Figure 7C:
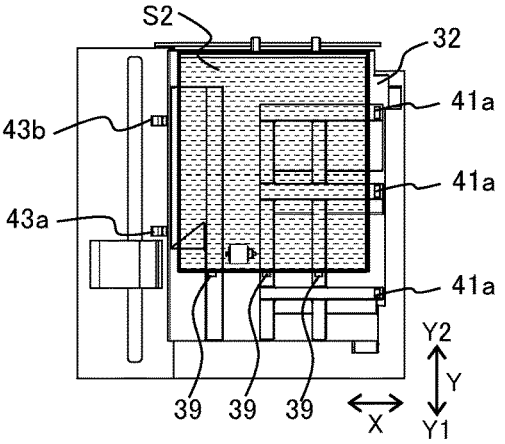

FIG. 7C illustrates a state in which the leading end of the first sheet S2 is in contact with the longitudinal alignment reference plates 39 and the alignment in the conveyance direction Y has been completed. After this, the lateral movement motor 48 is driven to perform the lateral alignment operation, that is, the alignment operation in the width direction X, of moving the lateral alignment moving member 41 in the alignment direction, that is, toward one side in the width direction X corresponding to the left side in FIG. 7C. To be noted, the power supply to the solenoid 60 is stopped before the side end pressing surfaces 41*a* of the lateral alignment moving member 41 abut the sheet S2, and the longitudinal alignment roller 33 is separated from the sheet S2. The lateral alignment moving member 41 is stopped at a position where the distance from the side end pressing surfaces 41*a* to the lateral alignment reference plates 43*a* and 43*b* in the width direction X is equal to the sheet width of the sheet S2, or a position where the distance is slightly smaller than the sheet width. As a result of this, the side end portions of sheets S2 are caused to abut the lateral alignment reference plates 43*a* and 43*b*, and thus the positions of the sheets S2 in the width direction X are aligned in accordance with the lateral alignment reference plates 43*a* and 43*b*.

Figure 7D:
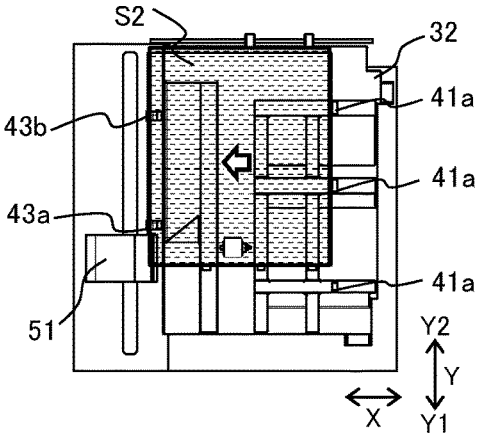

FIG. 7D illustrates a state in which the side end portion of the first sheet S2 is in contact with the lateral alignment reference plate 43, and the alignment in the width direction X has been completed. After this, the lateral alignment moving member 41 is moved in a retraction direction, that is, toward the right side in FIG. 7D, and thus it becomes possible to receive the second sheet S2.

Then, the operation illustrated in FIGS. 7A to 7D is repeated by a number of times corresponding to a predetermined number of sheets. The predetermined number of sheets is, for example, the number of sheets that are to be one copy of a sheet bundle by being bound by the binding process. After the alignment of the predetermined number of sheets is finished, the binding process is performed by the stapler 51. In addition, in the case of performing the binding process by stapling a plurality of positions on the sheets, the stapling is repeatedly performed while moving the stapler 51 in the conveyance direction Y from a stapling position to another stapling position.

Figure 7E:
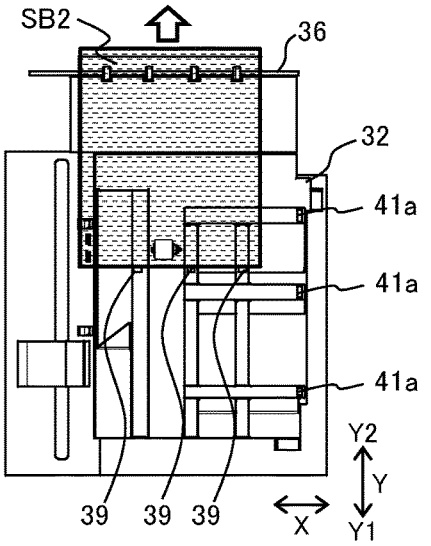

FIG. 7E illustrates a state in which all stapling has been finished and a processed sheet bundle SB2 is being discharged. Since the longitudinal alignment reference plates 39 also function as discharge members of the intermediate supporting portion 42 in the present embodiment, the longitudinal alignment reference plates 39 push the trailing end of the sheet bundle SB2 in the bundle discharge direction Y2, and thus convey the sheet bundle SB2 toward the bundle discharge rollers 36 in the bundle discharge direction Y2. The bundle discharge rollers 36 are a roller pair capable of opening and closing, and the nip portion thereof is opened in advance before receiving the sheet bundle SB2. The longitudinal alignment reference plates 39 stop at a time point when the leading end of the sheet bundle SB2 in the bundle discharge direction Y2 is conveyed to a position a little beyond the nip position of the bundle discharge rollers 36, and then a nipping operation of closing the bundle discharge rollers 36 is performed. In addition, the bundle discharge rollers 36 are rotated by an unillustrated driving unit to discharge the sheet bundle SB2 toward the lower discharge tray 37 illustrated in FIG. 1.

After passing the sheet bundle SB2 onto the bundle discharge rollers 36, the longitudinal alignment reference plates 39 return to the standby positions illustrated in FIG. 7A again. In addition, as illustrated in FIG. 7E, the longitudinal alignment reference plates 39 have moved further downstream across movement regions of the lateral alignment moving member 41.

Figure 8B:
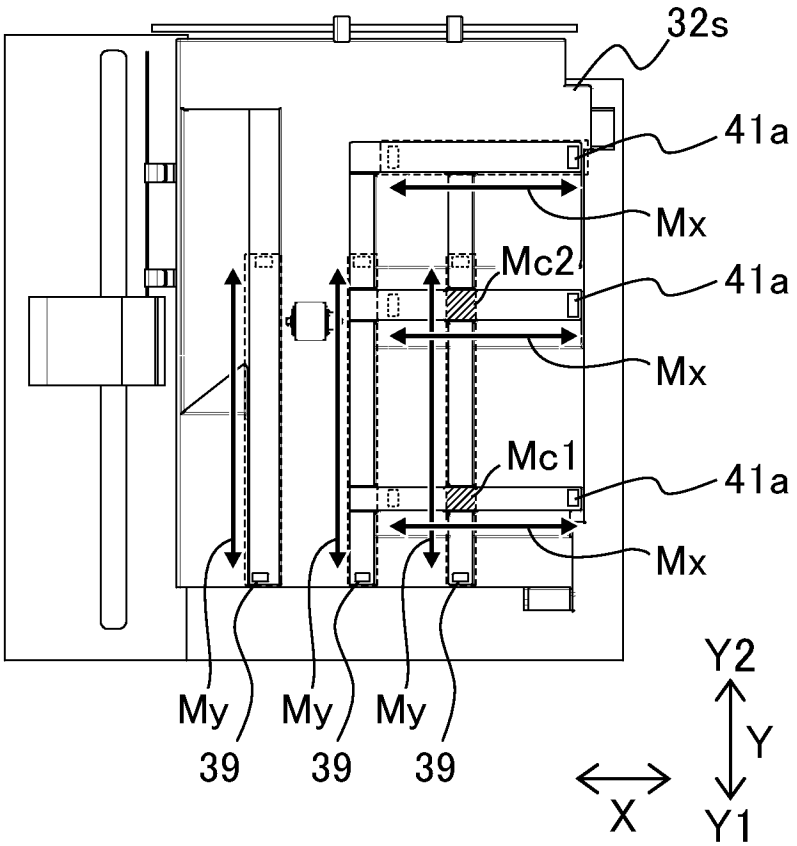
FIGS. 8A and 8B are each a diagram for describing an operation of the intermediate supporting portion according to the first embodiment.
Figure 8A:
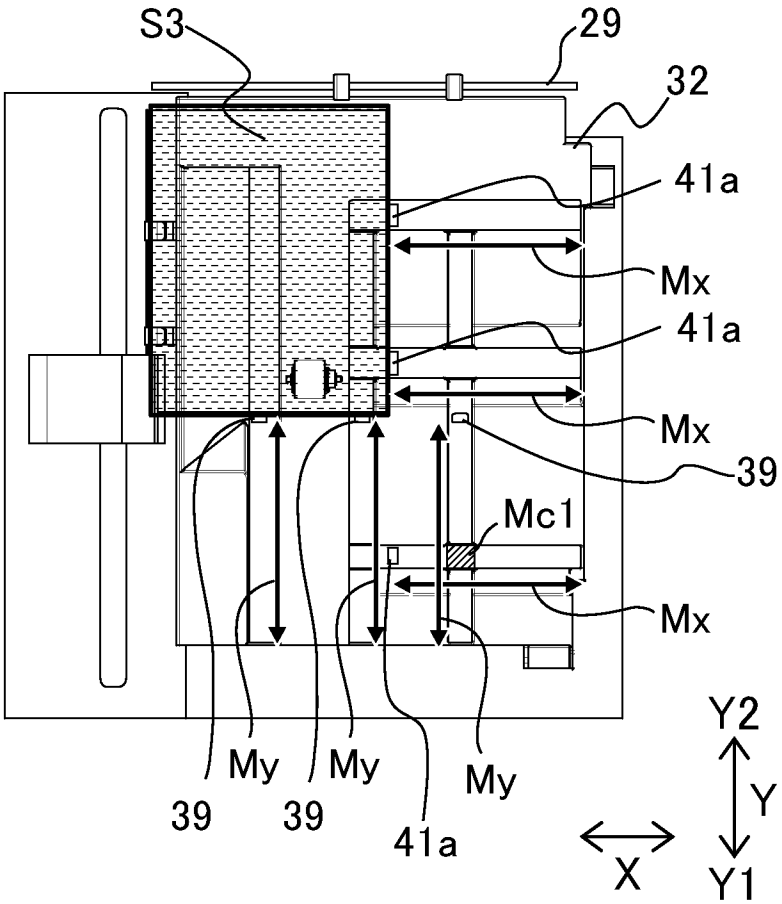

Movement Ranges of Longitudinal Movement Unit and Lateral Alignment Moving Member FIG. 8A, illustrates a state in which sheets S3 of the minimum size that can be aligned by the intermediate supporting portion 42 of the present embodiment have been aligned. For example, the minimum size is an A5 size. Arrows in FIG. 8A indicate movement regions My of the longitudinal alignment reference plates 39 and movement regions Mx of the side end pressing surfaces 41*a* of the lateral alignment moving member 41 on the supporting surface 32*s* of the intermediate supporting plate 32. As illustrated in FIG. 8A, it can be seen that the side end pressing surfaces 41*a* of the lateral alignment moving member 41 have moved to positions beyond the movement region My of the longitudinal alignment reference plate 39 on the right side in FIG. 8A among the movement regions My of the three longitudinal alignment reference plates 39. In other words, there is a region Mc1 where a movement region My for a longitudinal alignment reference plate 39 to move in for alignment of sheets and a movement region Mx for a side end pressing surface 41*a* of the lateral alignment moving member 41 to move in for alignment of sheets intersect with each other on the supporting surface 32*s* of the intermediate supporting plate 32.

In addition, FIG. 8B illustrates the relationship between the movement regions My in which the longitudinal alignment reference plates 39 serving as push-out members that push out the sheets from the intermediate supporting portion 42 and the movement regions Mx in which the side end pressing surfaces 41*a* of the lateral alignment moving member 41 serving as an alignment member is movable. As illustrated in FIG. 8B, there are regions Mc1 and Mc2 where a movement region My in which a longitudinal alignment reference plate 39 move for pushing out, that is, discharging the sheets and movement regions Mx in which side end pressing surfaces 41*a* of the lateral alignment moving member 41 move for aligning the sheets intersect with each other. To be noted, the movement regions My of the longitudinal alignment reference plates 39 and the movement regions Mx of the lateral alignment moving member 41 illustrated in FIGS. 8A and 8B are mere examples, and may be appropriately changed in accordance with the size of the sheets to be processed in the intermediate supporting portion 42.

As has been already described, the longitudinal alignment reference plates 39, the side end pressing surfaces 41*a* of the lateral alignment moving member 41, and the lateral alignment reference plates 43*a* and 43*b* are each provided in a plural number. As illustrated in FIGS. 6A, 6B, 8A, and 8B, these members are each disposed to abut at least two portions of the sheet end portion, between which the center of gravity of the sheets is positioned in both the conveyance direction Y and the width direction X, for every sheet size compatible with the intermediate supporting portion 42. That is, for a plurality of sheet sizes, no matter sheets of which size are supported on the intermediate supporting portion 42, at least one of the longitudinal alignment reference plates 39 is positioned on a first side in the width direction X with respect to the center of gravity of the sheets, and at least one of the other longitudinal alignment reference plates 39 is positioned on a second side in the width direction X with respect to the center of gravity of the sheets. In addition, for a plurality of sheet sizes, no matter sheets of which size are supported on the intermediate supporting portion 42, at least one of the side end pressing surfaces 41*a* is positioned on a first side in the conveyance direction Y with respect to the center of gravity of the sheets, and at least one of the other side end pressing surfaces 41*a* is positioned on a second side in the conveyance direction Y with respect to the center of gravity of the sheets. The lateral alignment reference plates 43*a* and 43*b* also have a similar positional relationship.

In addition, the side end pressing surfaces 41*a* are disposed such that the standby positions of the longitudinal alignment reference plates 39, that is, alignment reference positions thereof in the conveyance direction Y for each sheet size do not interfere with the movement regions Mx of the side end pressing surfaces 41*a*.

To be noted, the layout and number of the longitudinal alignment reference plates 39, the side end pressing surfaces 41*a* of the lateral alignment moving member 41, and the lateral alignment reference plates 43*a* and 43*b* can be appropriately modified in accordance with the use purpose of the intermediate supporting portion 42. In addition, although a configuration in which timing belts are used as moving units for the longitudinal alignment reference plates 39 and the lateral alignment moving member 41 has been described in the present embodiment, the configuration is not limited to the configuration using a timing belt. For example, a configuration in which a rack-and-pinion mechanism or a feed screw is used may be employed.

Summary of Present Embodiment

As described above, the longitudinal movement driving portion 69A that moves the longitudinal alignment reference plates 39 and the lateral movement driving portion 48A that moves the lateral alignment moving member 41 are respectively provided in an upper layer and a lower layer of the intermediate supporting plate 32. In other words, the lateral movement driving portion 48A serving as a first moving unit is disposed below the intermediate supporting plate 32 serving as a supporting portion in the thickness direction Z, and the longitudinal movement driving portion 69A serving as a second moving unit is disposed above the intermediate supporting plate 32 in the thickness direction Z. To be noted, "above" and "below" respectively correspond to the upper side and the lower side of a surface of the intermediate supporting plate 32, which extends in the conveyance direction Y and the width direction X, in the thickness direction Z perpendicular to the conveyance direction Y and the width direction X. Therefore, the positions of the longitudinal movement driving portion 69A and the lateral movement driving portion 48A in the gravity direction may overlap with the position of the intermediate supporting plate 32 in the gravity direction.

If the longitudinal movement driving portion 69A and the lateral movement driving portion 48A, which move the longitudinal alignment reference plates 39 and the lateral alignment moving member 41 in intersecting directions, are both disposed on the upper side or both disposed on the lower side of the intermediate supporting plate 32, these driving portions may interfere with each other. In contrast, in the present embodiment, by disposing the longitudinal movement driving portion 69A and the lateral movement driving portion 48A respectively on the upper side and the lower side of the intermediate supporting plate 32, interference between the two moving units 69A and 48A can be avoided even in the case where the movement ranges of the longitudinal alignment reference plates 39 and the lateral alignment moving member 41 are widened.

In the present embodiment, a movement region Mx of the lateral alignment moving member 41 serving as a first alignment member on the intermediate supporting plate 32 intersects with a movement region My of a longitudinal alignment reference plate 39 serving as second alignment members on the intermediate supporting plate 32, as indicated by the region Mc1 in FIG. 8A. Further, at least one of the longitudinal alignment reference plates 39 can move to at least two positions between which a movement region Mx of the lateral alignment moving member 41 is positioned in the conveyance direction Y, as indicated by the longitudinal alignment reference plate 39 on the right side in FIGS. 6A and 6B. In addition, at least one of the side end pressing surfaces 41*a* of the lateral alignment moving member 41 can move to at least two positions between which a movement region My of the longitudinal alignment reference plates 39 is positioned in the width direction X, as indicated by the side end pressing surface 41*a* positioned on the bottom in FIGS. 6B and 8A. Therefore, the alignment operation using the lateral alignment moving member 41 and the longitudinal alignment reference plates 39 can be performed on sheets of various sizes.

In addition, in the present embodiment, a movement region Mx of the lateral alignment moving member 41 serving as an alignment member on the intermediate supporting plate 32 intersects with a movement region My of the longitudinal alignment reference plates 39 serving as push-out members on the intermediate supporting plate 32 as indicated by the regions Mc1 and Mc2 in FIG. 8B. Further, at least one of the longitudinal alignment reference plates 39 can perform the operation of pushing out the sheets from the intermediate supporting portion 42 while moving across a movement region Mx of the lateral alignment moving member 41 in the conveyance direction Y as indicated by the longitudinal alignment reference plate 39 on the right side in FIGS. 7D and 7E. In addition, at least one of the side end pressing surfaces 41*a* of the lateral alignment moving member 41 can move to at least two positions between which a movement region My of the longitudinal alignment reference plates 39 is positioned in the width direction X as indicated by the side end pressing surface 41*a* positioned on the bottom in FIGS. 6B and 8A. Therefore, the alignment operation using the lateral alignment moving member 41 and the push-out operation or discharge operation using the longitudinal alignment reference plates 39 can be performed on sheets of various sizes.

To be noted, the movement regions My of the longitudinal alignment reference plates 39 and the movement regions Mx of the lateral alignment moving member 41 do not have to actually intersect with each other on the intermediate supporting plate 32. That is, according to the configuration of the present embodiment, movement ranges of the longitudinal alignment reference plates 39 and the lateral alignment moving member 41 that are difficult to realize in a configuration in which the longitudinal movement driving portion 69A and the lateral movement driving portion 48A are both disposed on the lower side or the upper side of the intermediate supporting plate 32 can be realized according to the configuration of the present embodiment. For example, a layout in which the movement regions Mx and My of the longitudinal alignment reference plates 39 and the lateral alignment moving member 41 are in contact with each other as viewed in the thickness direction Z can be employed.

In addition, in the present embodiment, the slide holes 31*a* and 32*b* and the slide grooves 31*b* and 32*a* that guide the movement of the lateral alignment moving member 41 and the longitudinal alignment reference plates 39 are provided in the intermediate upper guide 31 and the intermediate supporting plate 32. As a result of this, a floating island portion that is a portion enclosed by through holes therearound is not generated in the intermediate upper guide 31 or the intermediate supporting plate 32, and therefore each of the intermediate upper guide 31 and the intermediate supporting plate 32 can be formed as one continuous part.

Further, the longitudinal alignment reference plates 39 and the lateral alignment moving member 41 extend to regions inside the slide grooves 31*b* and 32*a* through the slide holes 31*a* and 32*b*. That is, the longitudinal alignment reference plates 39 and the lateral alignment moving member 41 are disposed such that no gap is generated in the thickness direction Z between the longitudinal alignment reference plates 39 and the lateral alignment moving member 41 and the lower surface of the intermediate upper guide 31 and the supporting surface 32*s*, which is the upper surface of the intermediate supporting plate 32, that define a supporting space or sheet accommodating space in which the sheets are supported. Therefore, a sheet slipping through at the time of performing the alignment operation or pushing out and discharging the sheets can be prevented, and thus sheets can be handled more stably.

In addition, in the present embodiment, the longitudinal alignment reference plates 39 serving as alignment members in the conveyance direction Y also function as push-out members that push out the sheets from the intermediate supporting portion 42. Therefore, the size and cost of the apparatus can be reduced as compared with a case where the push-out members or discharge units and the moving unit thereof are provided separately from the alignment members and the moving unit thereof.

In addition, the plurality of longitudinal alignment reference plates 39 are disposed so as to abut at least two portions of the sheet end portion between which the center of gravity of the sheets is positioned in the width direction X for a plurality of sheet sizes, preferably all sheet sizes. Therefore, rotation of the sheets is not likely to occur when aligning or pushing out the sheets to discharge the sheets, and therefore the alignment of the sheets can be improved. In addition, the plurality of side end pressing surfaces 41*a* of the lateral alignment moving member 41 are disposed so as to abut at least two portions of the sheet end portion between which the center of gravity of the sheets is positioned in the conveyance direction Y for a plurality of sheet sizes, preferably all sheet sizes. The plurality of lateral alignment reference plates 43*a* and 43*b* are also disposed such that a similar positional relationship is established for a plurality of sheet sizes, preferably all sheet sizes. Therefore, rotation of the sheets is not likely to occur when aligning the sheets, and therefore the alignment of the sheets can be improved.

Incidentally, in the present embodiment, the longitudinal alignment reference plates 39 that are reference members serving as reference for alignment positions of the sheets in a predetermined direction and the longitudinal alignment roller 33 that is a moving member that causes the sheets to abut the longitudinal alignment reference plates 39 move while maintaining a certain positional relationship. The predetermined direction is the conveyance direction Y in the present embodiment. If the alignment in the conveyance direction Y is attempted in a state in which the positions where the longitudinal alignment reference plates 39 abut the sheets and the position where the longitudinal alignment roller 33 abuts the sheet are much more separated from each other than in the present embodiment, there is a possibility that a sheet is kicked back and thus the positions of the sheets are disturbed. That is, there is a possibility that warpage of a sheet that can be also referred to as a loop is generated between the sheet abutting positions of the longitudinal alignment roller 33 and the longitudinal alignment reference plates 39 when the longitudinal alignment roller 33 rotates. In that case, the sheet may be stretched when the longitudinal alignment roller 33 retracts upward, and thus the sheet is separated from the longitudinal alignment reference plates 39 as a reaction. In contrast, in the present embodiment, since the longitudinal alignment roller 33 and the longitudinal alignment reference plates 39 move while maintaining a certain distance therebetween in the conveyance direction Y, the kickback can be suppressed to improve the alignment of sheets even in the case where the positions of the longitudinal alignment reference plates 39 are changed.

In addition, in the present embodiment, since a configuration in which the longitudinal alignment reference plates 39 and the longitudinal alignment roller 33 are both moved by the longitudinal movement driving portion 69A is employed, the size and cost of the apparatus can be reduced while improving the alignment as described above.

Modification Example

Although the longitudinal movement driving portion 69A is disposed above the intermediate supporting plate 32 and the lateral movement driving portion 48A is disposed below the intermediate supporting plate 32 in the present embodiment, this positional relationship may be swapped. That is, the longitudinal movement driving portion 69A serving as a first moving unit may be disposed below the intermediate supporting plate 32 serving as a supporting portion, and the lateral movement driving portion 48A serving as a second moving unit may be disposed above the intermediate supporting plate 32.

In addition, the alignment method for the sheets in the conveyance direction Y and the width direction X is not limited to the example described in the present embodiment. For example, the sheets may be caused to abut the longitudinal alignment reference plates 39 by a rotating moving member of a belt shape or a paddle shape instead of the longitudinal alignment roller 33, or the sheets may be caused to abut the longitudinal alignment reference plates 39 by pressing an end portion of the sheets by a plate-shaped longitudinal alignment moving member. In addition, a configuration in which both of two alignment members opposing each other in the width direction X, such as the lateral alignment moving member 41 and the lateral alignment reference plates 43*a* and 43*b*, move toward each other and thus the alignment is performed may be employed instead of a one-side reference system in which only one of the two alignment members move toward the other and thus the alignment in the width direction X is performed.

Second Embodiment

Figure 9:
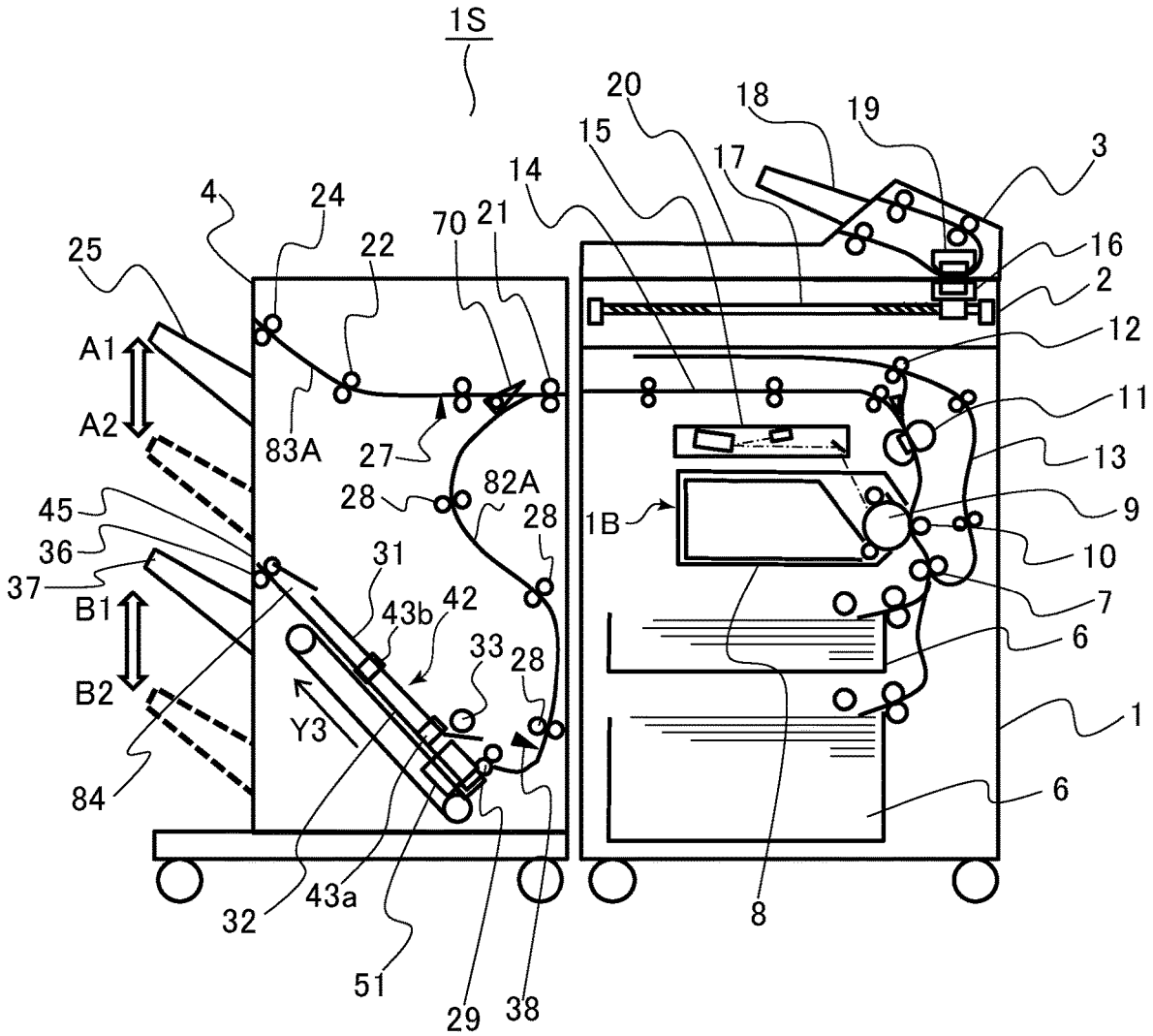
FIG. 9 is a schematic view of a post-processing apparatus and an image forming apparatus according to a second embodiment.
Figure 10:
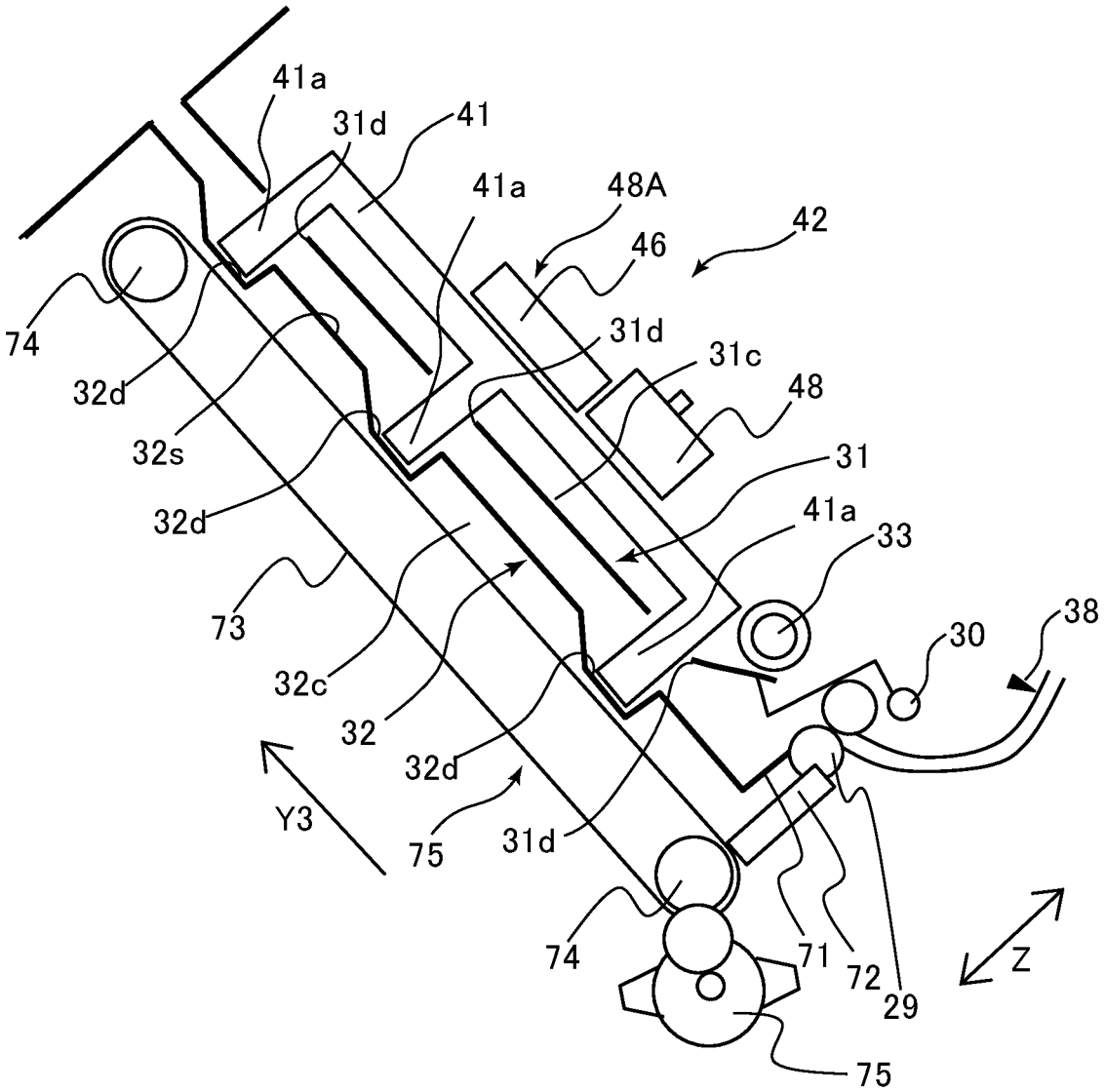
FIG. 10 is a section view of an intermediate supporting portion according to the second embodiment.

A second embodiment will be described with reference to FIGS. 9 and 10. FIG. 9 is a schematic view of the image forming system 1S of the present embodiment. FIG. 10 is a schematic enlarged view of the intermediate supporting portion 42 of the present embodiment. The image forming apparatus 1, the image reading apparatus 2, and the document feeding apparatus 3 are configured in essentially the same manner as in the first embodiment, and therefore the description thereof will be omitted. Also for the post-processing apparatus 4, elements configured in essentially the same manner as in the first embodiment will be denoted by the same reference signs, and detailed description thereof will be omitted.

As illustrated in FIG. 9, a sheet discharged from the horizontal conveyance portion 14 of the image forming apparatus 1 is passed onto the inlet rollers 21 of the post-processing apparatus 4. A flap 70 serving as a switching member that switches conveyance paths is provided downstream of the inlet rollers 21. The flap 70 can be switched between an upper position illustrated in FIG. 9 and a lower position to which the flap 70 has rotated in the clockwise direction in FIG. 9 from the upper position by an unillustrated actuator, and thus can switch the conveyance path of the sheet.

When conveying the sheet onto the upper discharge tray 25, the flap 70 is switched from the upper position to the lower position. As a result of this, the sheet delivered out from the inlet rollers 21 is conveyed to a first discharge path 83A. Then, the conveyance speed of the conveyance rollers 22 and discharge rollers 24A is controlled on the basis of the time point at which the trailing end of the sheet has passed the entrance sensor 27, and thus the sheet is discharged onto the upper discharge tray 25.

In the case where the discharge destination of the sheet is the lower discharge tray 37, the flap 70 is maintained at the upper position. As a result of this, the sheet delivered out from the inlet rollers 21 is conveyed to an in-body discharge path 82A, and is conveyed to the intermediate supporting portion 42 including the intermediate upper guide 31 and the intermediate supporting plate 32 by the kick-out rollers 29 through the intermediate conveyance rollers 28.

As illustrated in FIG. 10, a longitudinal alignment reference plate 71 is disposed in the most upstream portion of the intermediate supporting portion 42. To be noted, in the present embodiment, the conveyance direction in which the kick-out rollers 29 discharge the sheet onto the intermediate supporting portion 42 and the conveyance direction in which the sheet is discharged from the intermediate supporting portion 42 are substantially the same. Hereinafter, this direction will be referred to as a conveyance direction Y3. The longitudinal alignment reference plate 71 described above is a wall surface erecting upward in the thickness direction Z from the most upstream portion of the supporting surface 32*s* of the intermediate supporting plate 32 in the conveyance direction Y3.

In addition, the longitudinal alignment roller 33 that functions as a moving member for conveying the sheet having passed through the kick-out rollers 29 toward the longitudinal alignment reference plate 71 is provided above the intermediate supporting plate 32. After the trailing end of the sheet has passed the pre-intermediate supporting sensor 38, the longitudinal alignment roller 33 is lowered by an unillustrated actuator to abut the upper surface of the sheet supported on the intermediate supporting plate 32, and conveys the sheet upstream in the conveyance direction Y3 toward the longitudinal alignment reference plate 71 at a predetermined timing. As a result of this, the trailing end of the sheet in the conveyance direction Y3 is caused to abut the longitudinal alignment reference plate 71, and thus the positions of sheets in the conveyance direction Y3 are aligned in accordance with the longitudinal alignment reference plate 71 serving as a reference member. To be noted, the bundle pressing flag 30 that pushes down the trailing end of the sheet is rotatably supported at a position downstream of the kick-out rollers 29.

After the trailing end of the sheet has abutted the longitudinal alignment reference plate 71, the alignment operation in the width direction X, that is, lateral alignment operation is performed by the lateral alignment moving member 41. The lateral alignment moving member 41 is engaged with an unillustrated timing belt, and can be moved in the width direction X along the rail 46 by the rotation of the timing belt. The timing belt is stretched by an unillustrated pulley pair, and the pulley pair is connected to the lateral movement motor 48 via an unillustrated drive train. The rail 46, the timing belt, and the pulley pair constituting the lateral movement driving portion 48A serving as a first moving unit of the present embodiment are all disposed above the intermediate upper guide 31 in the thickness direction Z.

The lateral alignment moving member 41 has the plurality of side end pressing surfaces 41*a* extending to regions inside lateral slide grooves 32*d* serving as first grooves provided in the intermediate supporting plate 32 through lateral slide holes 31*d* serving as second holes provided in the intermediate upper guide 31. In addition, the lateral alignment reference plates 43*a* and 43*b* serving as reference for the alignment position in the width direction X are disposed at similar positions to the first embodiment to oppose the side end pressing surfaces 41*a* in the width direction X as illustrated in FIGS. 3 and 4.

When the lateral movement driving portion 48A is driven by the lateral movement motor 48, the lateral alignment moving member 41 moves in the width direction X while pressing the side end of the sheets by the side end pressing surfaces 41*a*, and cause the other side end of the sheets to abut the lateral alignment reference plates 43*a* and 43*b*. As a result of this, the alignment operation of the sheets in the conveyance direction Y3 and the width direction X is finished. Then, the lateral alignment moving member 41 retracts in the width direction X to a position that does not hinder the conveyance of a subsequent sheet, and then the subsequent sheet is received.

When a predetermined number of sheets are stacked on the intermediate supporting portion 42 and the alignment operation on the last sheet is finished, the stapler 51 performs the binding process. The trailing end in the conveyance direction Y3 of a sheet bundle formed by the binding process is pressed by downstream movement of trailing end push-out members 72 serving as push-out members in the conveyance direction Y3, and thus the sheet bundle is pushed out from the intermediate supporting portion 42.

The trailing end push-out members 72 stop when the leading end of the sheet bundle in the conveyance direction Y3 is conveyed to a position a little beyond the nip position of the bundle discharge rollers 36 illustrated in FIG. 9. As a result of this, the sheet bundle passed onto the bundle discharge rollers 36 through a second discharge path 84 is discharged onto the lower discharge tray 37 by the bundle discharge rollers 36. The trailing end push-out members 72 move upstream in the conveyance direction Y3 and return to the position of FIG. 10 after passing the sheet bundle onto the bundle discharge rollers 36.

In FIG. 10, the plurality of trailing end push-out members 72 are arranged in the width direction X. The trailing end push-out members 72 extend to regions inside longitudinal slide grooves 31*c* serving as second grooves provided in the intermediate upper guide 31 through longitudinal slide holes 32*c* serving as first holes provided in the intermediate supporting plate 32. The plurality of trailing end push-out members 72 are attached to a timing belt 73 in an integrated manner. The timing belt 73 is stretched by a pulley pair 74, and the pulley pair 74 is driven by a longitudinal movement motor 75 to rotate. That is, the plurality of trailing end push-out members 72 are reciprocated in the conveyance direction Y3 by the normal rotation and reverse rotation of the longitudinal movement motor 75. The timing belt 73 and the pulley pair 74 constituting a longitudinal movement driving portion 75A serving as a second moving unit of the present embodiment are both disposed below the intermediate supporting plate 32 in the thickness direction Z.

Summary of Present Embodiment

As described above, the longitudinal movement driving portion 75A that moves the trailing end push-out members 72 and the lateral movement driving portion 48A that moves the lateral alignment moving member 41 are respectively disposed above and below the intermediate supporting plate 32. In other words, the lateral movement driving portion 48A serving as a first moving unit is disposed above the intermediate supporting plate 32 serving as a supporting portion in the thickness direction Z, and the longitudinal movement driving portion 75A serving as a second moving unit is disposed below the intermediate supporting plate 32 in the thickness direction Z.

As a result of this, the interference between the moving units 75A and 48A can be avoided even in the case where the movement ranges of the trailing end push-out members 72 serving as push-out members and the lateral alignment moving member 41 serving as an alignment member are widened. Particularly, in the present embodiment, a configuration in which a movement range of the trailing end push-out members 72 intersects with a movement range of the side end pressing surfaces 41*a* of the lateral alignment moving member 41 on the intermediate supporting plate 32 as illustrated in FIG. 8B is employed. Therefore, the alignment operation and the push-out operation or discharge operation can be performed stably for a wider variety of sheet sizes.

In addition, in the present embodiment, the slide holes 31*d* and 32*c* and the slide grooves 31*c* and 32*d* that guide the movement of the lateral alignment moving member 41 and the trailing end push-out members 72 are provided in the intermediate upper guide 31 and the intermediate supporting plate 32. As a result of this, a floating island portion that is a portion enclosed by through holes therearound is not generated in the intermediate upper guide 31 or the intermediate supporting plate 32, and therefore each of the intermediate upper guide 31 and the intermediate supporting plate 32 can be formed as one continuous part.

Further, the trailing end push-out members 72 and the lateral alignment moving member 41 extend to regions inside the slide grooves 31*c* and 32*d* through the slide holes 31*d* and 32*c*. That is, the trailing end push-out members 72 and the lateral alignment moving member 41 are disposed such that no gap is generated in the thickness direction Z between the trailing end push-out members 72 and the lateral alignment moving member 41 and the lower surface of the intermediate upper guide 31 and the supporting surface 32*s*, which is the upper surface of the intermediate supporting plate 32, that define the supporting space. Therefore, a sheet slipping through at the time of performing the alignment operation or pushing out and discharging the sheets can be prevented, and thus sheets can be handled more stably.

In addition, the plurality of trailing end push-out members 72 are disposed so as to abut at least two portions of the sheet end portion between which the center of gravity of the sheets is positioned in the width direction X for a plurality of sheet sizes, preferably all sheet sizes. Therefore, rotation of the sheets is not likely to occur when pushing out and discharging the sheets, and thus the sheets can be handled stably. In addition, the plurality of side end pressing surfaces 41*a* of the lateral alignment moving member 41 are disposed so as to abut at least two portions of the sheet end portion between which the center of gravity of the sheets is positioned in the conveyance direction Y for a plurality of sheet sizes, preferably all sheet sizes. The plurality of lateral alignment reference plates 43*a* and 43*b* are also disposed such that a similar positional relationship is established for a plurality of sheet sizes, preferably all sheet sizes. Therefore, rotation of the sheets is not likely to occur when aligning the sheets, and thus the sheets can be handled stably.

To be noted, although the longitudinal movement driving portion 75A is disposed below the intermediate supporting plate 32 and the lateral movement driving portion 48A is disposed above the intermediate upper guide 31 in the present embodiment, the positional relationship may be swapped. That is, the lateral movement driving portion 48A serving as a first moving unit may be disposed below the intermediate supporting plate 32 serving as a supporting portion, and the longitudinal movement driving portion 75A serving as a second moving unit may be disposed above the intermediate upper guide 31.

Third Embodiment

As a third embodiment, a configuration and a method that enable easily removing a jammed sheet from the intermediate supporting portion 42 in the case where a jam has occurred in the intermediate supporting portion 42 will be described. In the description below, it is assumed that elements denoted by the same reference signs as in the first embodiment have substantially the same configurations and effects as in the first embodiment.

The intermediate supporting portion 42 is divided into an upper unit 101 and a lower unit 102 with the intermediate supporting plate 32 therebetween as illustrated in FIG. 4. The upper unit 101 is a unit including the intermediate upper guide 31, the longitudinal movement unit 56, and the longitudinal movement driving portion 69A, and is positioned above the lower unit 102. The lower unit 102 is a unit including the intermediate supporting plate 32, the lateral alignment moving member 41, the lateral movement driving portion 48A, and the stapler 51.

The lower unit 102 includes a pair of props 103, and the props 103 each include a fulcrum shaft 104. The props 103 are members erecting upward in approximately the thickness direction Z from a base member, and oppose each other in the width direction X. The fulcrum shafts 104 are disposed on the inner sides of the pair of props 103, and each project in approximately the width direction X. In addition, in the conveyance direction Y, the fulcrum shafts 104 are provided in the vicinity of the downstream end of the intermediate supporting plate 32 in the longitudinal alignment direction Y1.

The upper unit 101 has a pair of fulcrum holes 105, and the fulcrum holes 105 are respectively engaged with the fulcrum shafts 104. In the conveyance direction Y, the fulcrum holes 105 are provided in the vicinity of the downstream end of the intermediate upper guide 31 in the longitudinal alignment direction Y1. Therefore, the upper unit 101 is rotatably supported in a direction to move away from the intermediate supporting plate 32, that is, approximately the thickness direction Z, about the fulcrum holes 105. That is, the upper unit 101 is configured to be pivotable such that an upstream end portion of the intermediate upper guide 31 in the longitudinal alignment direction Y1 pivots upward in approximately the thickness direction Z about an axis extending substantially in the width direction X and passing through a downstream end portion of the intermediate upper guide 31 in the longitudinal alignment direction Y1. In addition, a link shaft 90 is attached to the upper unit 101 so as to be integrated with the intermediate upper guide 31. The link shaft 90 projects in the width direction X from one side portion of the intermediate upper guide 31 in the width direction X.

Figure 11B:
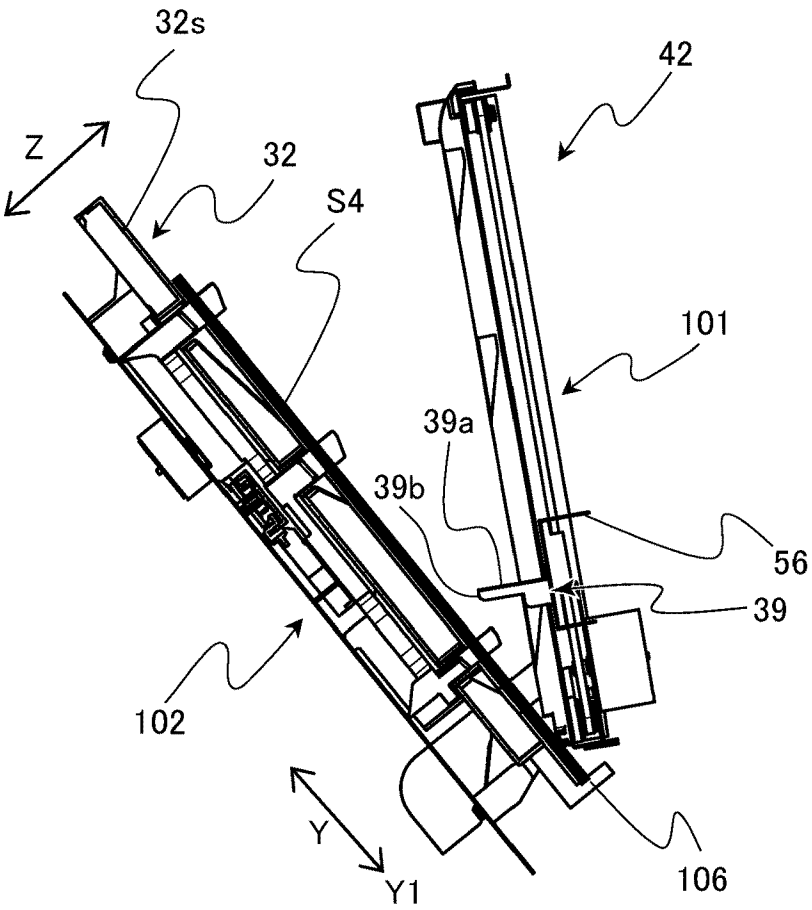
FIGS. 11A and 11B are each a diagram for describing an operation of an upper unit according to a third embodiment.
Figure 11A:
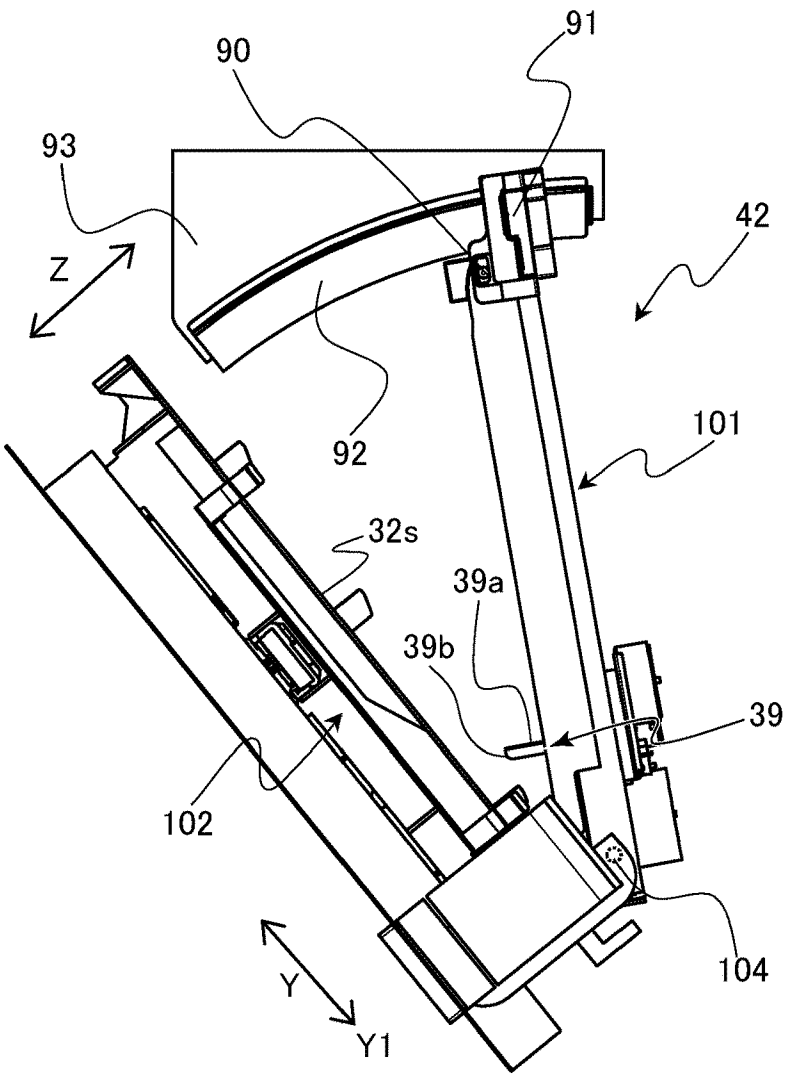

FIGS. 11A and 11B illustrate a state in which the upper unit 101 is separated from the lower unit 102 to remove a jammed sheet. FIG. 11A is a front view of the intermediate supporting portion 42 as viewed from the front side of the post-processing apparatus 4. Here, the front side of the post-processing apparatus 4 is one side in the width direction X, and corresponds to the front side of FIG. 1 and the left-front side of FIG. 4. FIG. 11B is a section view of the intermediate supporting portion 42 taken along a plane perpendicular to the width direction X as viewed from the front side.

As illustrated in FIG. 11A, a handle 91 serving as an operation portion or a gripping portion that a user can grip and operate to open the intermediate supporting portion 42 is provided in the post-processing apparatus 4. The handle 91 is engaged with the link shaft 90, and these two move integrally. In addition, the handle 91 is configured to move along a handle rail 92. The handle rail 92 is fixed to a portion 93 of the casing of the post-processing apparatus 4. The handle rail 92 has an arcuate shape centered on the fulcrum shaft 104, and the user can move the handle 91 along the handle rail 92 to separate the upper unit 101 from the lower unit 102 and bring the upper unit 101 into contact from the lower unit 102.

By separating the upper unit 101 from the lower unit 102 and putting a hand into a space between the upper unit 101 and the lower unit 102 as illustrated in FIG. 11A, the user can access and remove a jammed sheet S4 remaining in the intermediate supporting portion 42. At this time, in some cases, the longitudinal alignment reference plates 39 are retracted upward in the thickness direction Z to such positions that the distal ends of the longitudinal alignment reference plates 39 do not overlap with the supporting surface 32*s* of the intermediate supporting plate 32 as illustrated in FIG. 11B, depending on the stopped positions of the longitudinal alignment reference plates 39. In this case, there is a possibility that the jammed sheet S4 placed on the supporting surface 32*s* drops to a space inside the post-processing apparatus 4 from the intermediate supporting plate 32 by its own weight when the upper unit 101 is opened.

In the present embodiment, a stopper 106 is provided in a lower portion, that is, a downstream end in the longitudinal alignment direction Y1 of the intermediate supporting plate 32, which is inclined such that a downstream side thereof in the longitudinal alignment direction Y1 is positioned lower than an upstream side thereof in the longitudinal alignment direction Y1, to prevent the jammed sheet S4 from dropping. The stopper 106 is a projection portion projecting upward in the thickness direction Z with respect to the supporting surface 32*s* of the intermediate supporting plate 32. As a result of providing the stopper 106, even if the jammed sheet S4 slips through the longitudinal alignment reference plates 39 and slips downward when the handle 91 is operated and the upper unit 101 is opened, the jammed sheet S4 abuts the stopper 106 and thus further droppage thereof is restricted.

Figure 12A:
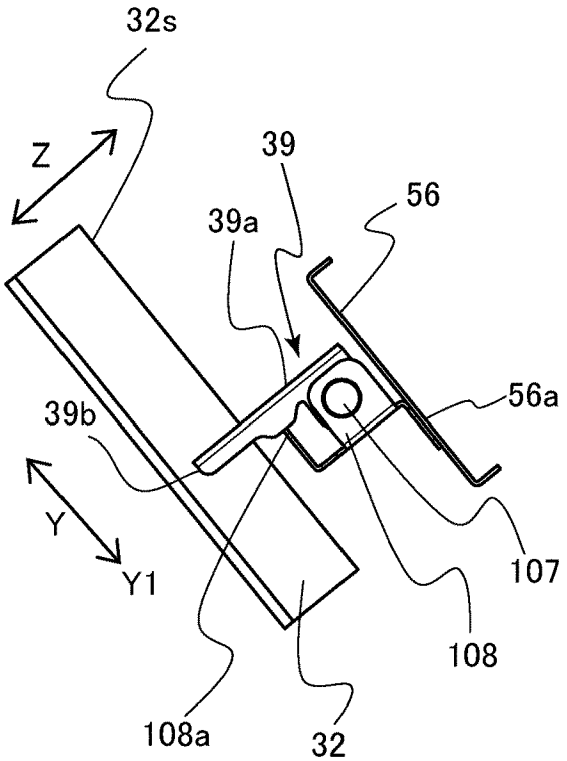
FIGS. 12A to 12C are each a diagram for describing an operation of longitudinal alignment reference plates according to the third embodiment.

Next, the detailed configuration of the longitudinal alignment reference plates 39 serving as alignment members of the present embodiment will be described. As illustrated in FIG. 12A, rotation shafts 107 penetrate the longitudinal alignment reference plates 39, and thus the longitudinal alignment reference plates 39 are rotatably supported by the rotation shafts 107. The rotation shafts 107 are each held by a holder 108, and the holder 108 is fixed to the support plate 56*a* that is a part of the longitudinal movement unit 56. The longitudinal alignment reference plates 39 each abut a stopper portion 108*a* that is a part of the holder 108 by their own weight, and are thus positioned. The position where the longitudinal alignment reference plates 39 each abut the stopper portion 108*a* serving as a third position is such a position that sheets can be aligned by causing the sheets to abut sheet abutting surfaces 39*a* of the longitudinal alignment reference plates 39 in a state in which the upper unit 101 is at a first position. In this state, distal ends or lower ends 39*b* of the longitudinal alignment reference plates 39 are positioned below the supporting surface 32*s* of the intermediate supporting plate 32 in the thickness direction Z. That is, in the case where the upper unit is positioned at the first position and the alignment members are positioned at the third positions with respect to the upper unit, the lower ends of the alignment members are positioned below the supporting surface 32*s* that is a surface on which the supporting portion supports the sheets. To be noted, when the longitudinal alignment reference plates 39 are at the third positions, the sheet abutting surfaces 39*a* of the longitudinal alignment reference plates 39 extend approximately in the thickness direction Z, that is, a direction approximately perpendicular to the supporting surface 32*s* of the intermediate supporting plate 32 as viewed in the width direction X.

In alignment of sheets in the intermediate supporting portion 42, the load acting on the longitudinal alignment reference plates 39 in the counterclockwise direction in FIG. 12A serving as a first rotation direction when a sheet is caused to abut the sheet abutting surfaces 39*a* by the longitudinal alignment roller 33 is received by the stopper portions 108*a*. As a result of this, the longitudinal alignment reference plates 39 are held at the third positions, and thus the positions of sheets are aligned by the sheet abutting surfaces 39*a*. Meanwhile, pivoting of the longitudinal alignment reference plates 39 in a direction away from the stopper portions 108*a*, that is, the clockwise direction in FIG. 12A serving as a second rotation direction is not restricted. In other words, the third positions according to the present embodiment are positions where the alignment members abut the stopper portions and rotation thereof in the first rotation direction is restricted, and the fourth positions are positions to which the alignment members have rotated from the third positions in a second rotation direction opposite to the first rotation direction.

Next, a procedure for removing a jammed sheet will be described. During the image forming operation, normally the upper unit 101 is at an abutting position serving as a first position illustrated in FIG. 2. In addition, the longitudinal alignment reference plates 39 are at the third positions illustrated in FIG. 12A. To be noted, FIGS. 12A to 12C each illustrate the longitudinal alignment reference plates 39 and the vicinity thereof as viewed in the width direction X.

In the case where a jam has occurred during the image forming operation and the jammed sheet S4 is present on the supporting surface 32*s*, the presence of the jammed sheet S4 is detected by the sheet presence/absence sensor 34 illustrated in FIG. 1. The jammed sheet S4 may be a sheet bundle. In this case, the controller of the image forming apparatus 1 notifies a user of the presence of a jammed sheet on the supporting surface 32*s* by a notification portion, and prompts the user to operate the handle 91 to move the upper unit 101 to a separation position and remove the jammed sheet S4. The notification portion mentioned herein refers to a display apparatus such as a liquid crystal panel included in the image forming apparatus, a loudspeaker that outputs a sound, or a communication function or the like that notifies a message to an external device that transmits an execution instruction of an image forming operation.

The user notified of the jam grips and operates the handle 91, and moves the upper unit 101 to a separation position illustrated in FIGS. 11A and 11B serving as a second position. At this time, the longitudinal alignment reference plates 39 move to positions away upward from the jammed sheet S4 on the intermediate supporting plate 32 while maintaining the relative positions with respect to the upper unit 101 as illustrated in FIGS. 11A and 11B. That is, in the case where the upper unit is at the second position and the alignment members are at the third positions with respect to the upper unit, the lower ends of the alignment members are separated upward from a sheet supporting surface of the supporting portion. The user puts the hand in the space between the upper unit 101 and the lower unit 102 to access and remove the jammed sheet S4 present in the intermediate supporting portion 42.

Figure 12B:
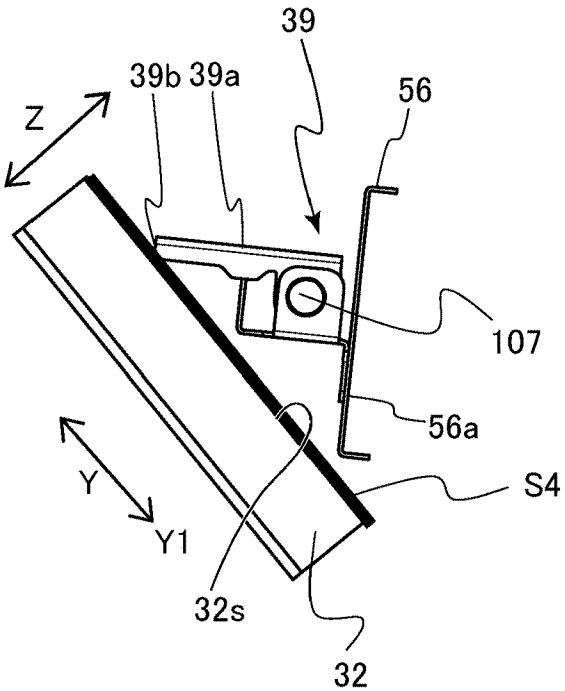
Figure 12C:
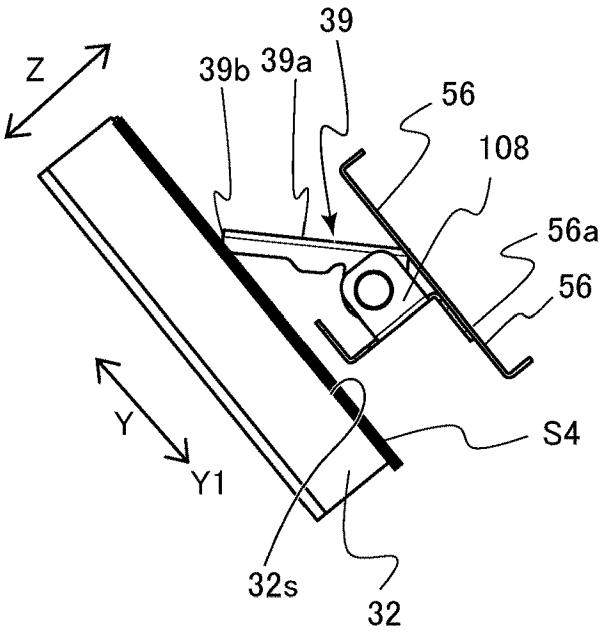

Next, the behavior of the longitudinal alignment reference plates 39 in the case where the user has closed the upper unit 101, that is, returned the upper unit 101 to the abutting position, without removing the jammed sheet S4 will be described. FIG. 12B illustrates a state in which the distal ends 39*b* of the longitudinal alignment reference plates 39 are abutting the jammed sheet S4 in the course of closing the upper unit 101 from the state in which the upper unit 101 is separated from the lower unit 102 while the jammed sheet S4 is still on the supporting surface 32*s*. The distal ends 39*b* of the longitudinal alignment reference plates 39 receive a reaction force from the jammed sheet S4, and thus the longitudinal alignment reference plates 39 stop the movement at positions illustrated in FIG. 12B. If it is attempted to further close the upper unit 101 in this state, the holders 108 and the longitudinal movement unit 56 eventually return to the first positions as illustrated in FIG. 12C. However, the longitudinal alignment reference plates 39 remain in the state in which the distal ends 39*b* are positioned above the supporting surface 32*s* of the intermediate supporting plate 32. That is, the longitudinal alignment reference plates 39 can remain at positions above the supporting surface 32*s* of the intermediate supporting plate 32 by relatively moving from the third positions to fourth positions with respect to the upper unit 101. In other words, the lower ends of the alignment members can remain above the sheet supporting surface of the supporting portion as a result of the alignment members relatively moving from the third positions to the fourth positions with respect to the upper unit in the course of the upper unit moving from the second position to the first position.

By employing the above-described configuration of the longitudinal alignment reference plates 39, damage to the jammed sheet S4 and damage to the apparatus can be suppressed even in the case where the user has moved the upper unit 101 from the separation position serving as a second position to the abutting position serving as a first position without removing the jammed sheet S4. If a configuration in which the longitudinal alignment reference plates 39 are fixed to the support plate 56*a* is employed, a large shearing force can act on the jammed sheet S4 in the case where the upper unit 101 is moved from the separation position serving as a second position to the abutting position serving as a first position without removing the jammed sheet S4. That is, a part of the jammed sheet S4, of which adjacent parts of the sheet S4 in the width direction X are supported by the supporting surface 32*s* on the both sides of the longitudinal alignment reference plates 39 in the width direction, and which is abutted by the distal end 39*b* of a longitudinal alignment reference plate 39, is pressed downward into a longitudinal slide groove 32*a*. Therefore, there is a possibility that wrinkles and tear occur in the jammed sheet S4. In addition, in the case where the jammed sheet S4 is formed from a material having sufficient stiffness or the jammed sheet S4 is a sheet bundle of a large number of sheets, the longitudinal alignment reference plates 39 or other members of the post-processing apparatus 4 can be damaged by the load of the reaction force from the jammed sheet S4. In contrast, according to the present embodiment, such problems can be avoided by the relative movement of the longitudinal alignment reference plates 39 with respect to the upper unit 101 even if the upper unit 101 is closed while the jammed sheet S4 is still present under the longitudinal alignment reference plates 39.

Further, when the user's hand trying to remove a jammed sheet touches a longitudinal alignment reference plate 39, the longitudinal alignment reference plate 39 moves and thus the space for removing the jammed sheet can be made bigger, and the possibility of the user's hand strongly hitting the longitudinal alignment reference plate 39 can be reduced.

In addition, as can be seen from FIG. 12B, such a layout/configuration that the direction of the reaction force that the distal ends 39*b* of the longitudinal alignment reference plates 39 receive from the jammed sheet S4 is a clockwise direction about the rotation shafts 107 in FIG. 12B is employed. That is, to align the leading ends of the sheets by the sheet abutting surfaces 39*a* of the longitudinal alignment reference plates 39, pivot in the counterclockwise direction in FIG. 12B serving as a first rotation direction about the rotation shaft 107 needs to be restricted by the stopper portions 108*a*. Meanwhile, allowing the pivot of the longitudinal alignment reference plates 39 in the clockwise direction in FIG. 12B serving as a second rotation direction does not degrade the alignment function of the sheet abutting surfaces 39*a*. Therefore, the longitudinal alignment reference plates 39 can retract to the fourth positions from the third positions by the reaction force from the jammed sheet S4 without using an actuator or the like. As a result of this, the size and cost of the apparatus can be reduced.

To be noted, also in the case where the upper unit 101 has been closed without removing the jammed sheet S4, the presence of the jammed sheet S4 remaining on the intermediate supporting plate 32 is detected by the sheet presence/absence sensor 34. In this case, the controller of the image forming apparatus 1 notifies the user of the presence of the jammed sheet S4 on the supporting surface 32*s* by the notification portion described above, and thus can prompt the user to remove the jammed sheet S4.

Modification Example of Movable Intermediate Supporting Plates

Next, a modification example of the present embodiment will be described with reference to FIGS. 13A to 13C. In this modification example, the longitudinal alignment reference plates 39 are held so as to be slidable along the holders 108 in a direction to move closer to and away from the supporting surface 32*s* approximately perpendicularly, that is, approximately in the thickness direction Z. The holders 108 are fixed to the support plate 56*a* that is a part of the longitudinal movement unit 56. Further, elastic members 110 such as coil springs are inserted between the longitudinal alignment reference plates 39 and the holders 108. The elastic members 110 urge the longitudinal alignment reference plates 39 downward in a direction approximately perpendicular to the supporting surface 32*s*, that is, toward the lower-left side in FIGS. 13A to 13C in approximately the thickness direction Z. That is, the elastic members 110 urge the longitudinal alignment reference plates 39 in a direction to move closer to the intermediate supporting plate 32. The third positions according to the present embodiment are positions where the alignment members project from the holders by the urging force of the elastic members, and the fourth positions are positions where the alignment members have slid in a direction away from the supporting portion while compressing the elastic member.

Figure 13A:
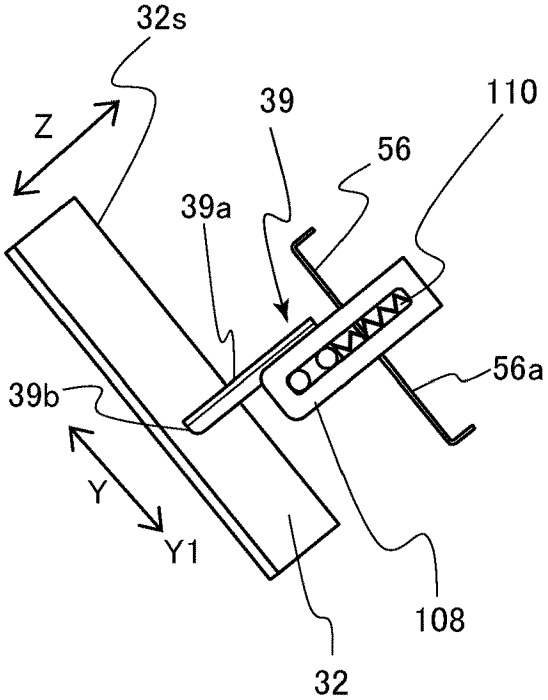
FIGS. 13A to 13C are each a diagram for describing an operation of longitudinal alignment reference plates according to a modification example of the third embodiment.

FIG. 13A illustrates a normal state during the image forming operation in which the upper unit 101 is at the abutting position serving as a first position, and the longitudinal alignment reference plates 39 are at third positions where the distal ends 39*b* thereof are positioned below the supporting surface 32*s* of the intermediate supporting plate 32. In the case where the user moves the upper unit 101 to the separation position serving as a second position in response to the jam notification, the longitudinal alignment reference plates 39 move while remaining at the third positions with respect to the upper unit 101, and the distal ends 39*b* of the longitudinal alignment reference plates 39 are separated upward from the supporting surface 32*s* of the intermediate supporting plate 32.

Figure 13B:
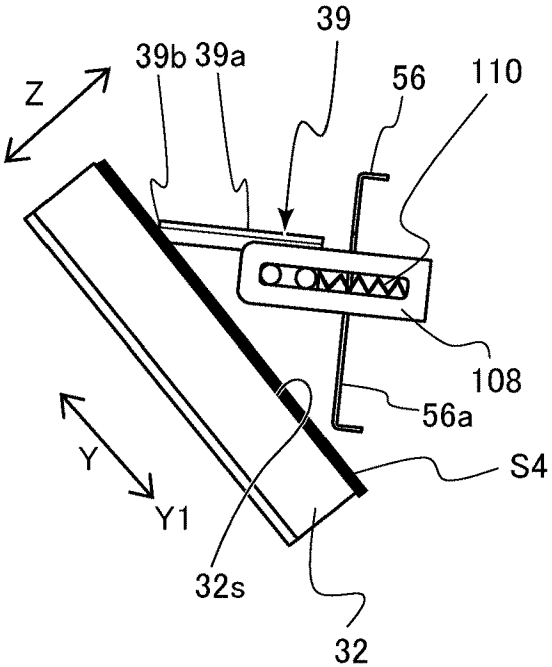
Figure 13C:
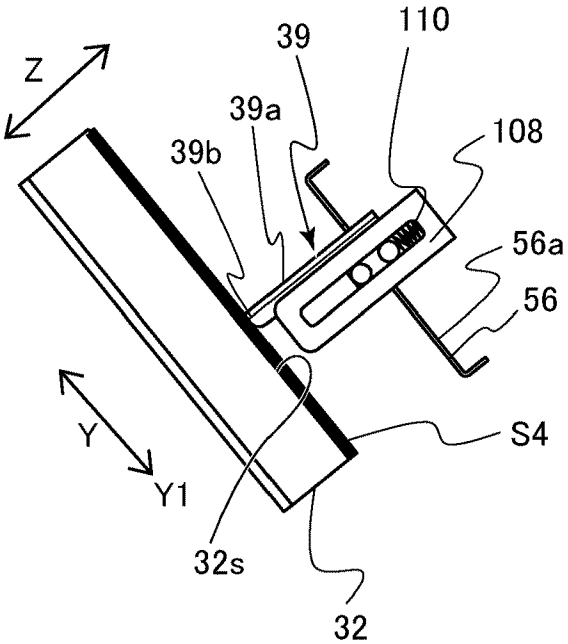

FIG. 13B illustrates a state in which the distal ends 39*b* of the longitudinal alignment reference plates 39 are abutting the jammed sheet S4 in the course of closing the upper unit 101 from the separation position serving as a second position while the jammed sheet S4 is still on the supporting surface 32*s*. In the case where the upper unit 101 is further closed from this state, the longitudinal alignment reference plates 39 receive a component force of a reaction force that the distal ends 39*b* thereof receive from the jammed sheet S4, in a direction along the slide direction with respect to the holders 108. As a result of this component force, the longitudinal alignment reference plates 39 gradually relatively move with respect to the holders 108 from the positions illustrated in FIG. 13B serving as third positions to positions illustrated in FIG. 13C serving as fourth positions while compressing the elastic members 110.

As a result of the relative movement of the longitudinal alignment reference plates 39 with respect to the holders 108, the distal ends 39*b* of the longitudinal alignment reference plates 39 can remain above the supporting surface 32*s* of the intermediate supporting plate 32. In other words, in the course of the movement of the upper unit from the second position to the first position, the lower ends of the alignment members can remain above the sheet supporting surface of the supporting portion as a result of the relative movement of the alignment members from the third positions to the fourth positions with respect to the upper unit. As a result of this, effects similar to those of the third embodiment described with reference to FIGS. 12A to 12C can be obtained.

Fourth Embodiment

Figure 14A:
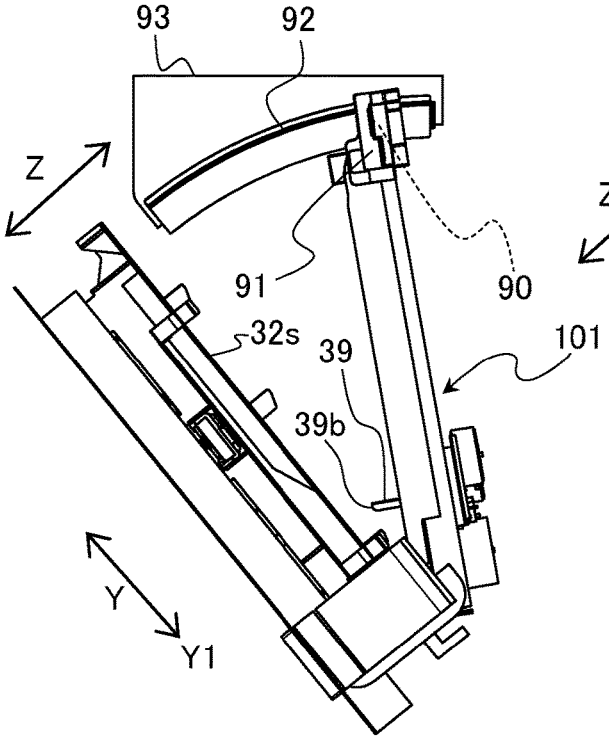
FIGS. 14A to 14D are each a diagram for describing an operation of an upper unit according to a modification example of a fourth embodiment.
Figure 14C:
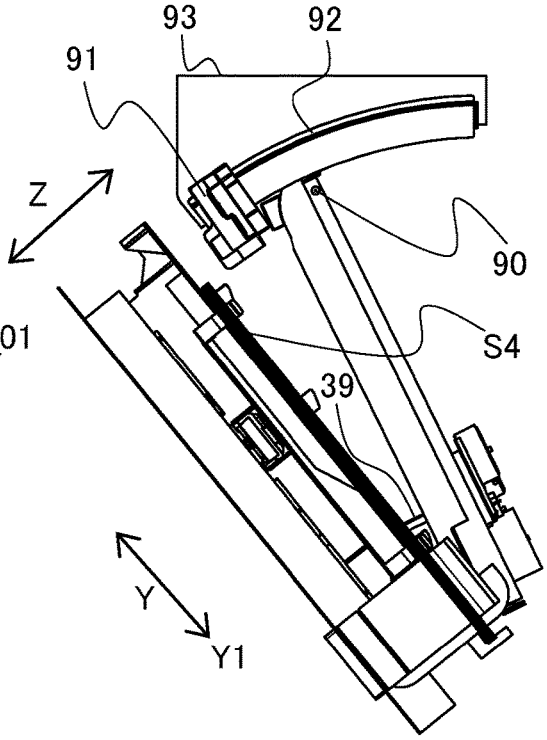
Figure 14B:
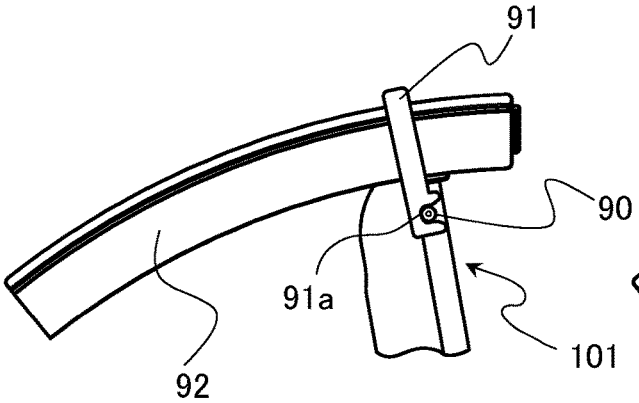
Figure 14D:
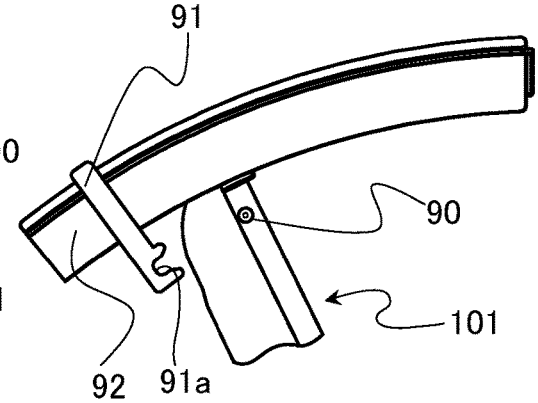

Further, another embodiment will be described with reference to FIGS. 14A to 14D. In the description below, it is assumed that elements denoted by the same reference signs as in the first and third embodiments have substantially the same configurations and effects as in the first and third embodiments. FIGS. 14A and 14C are each a front view of the intermediate supporting portion 42 as viewed from the front side of the post-processing apparatus 4. FIG. 14B is an enlarged view of FIG. 14A illustrating a positional relationship between the handle 91 and the link shaft 90. FIG. 14D is an enlarged view of FIG. 14C illustrating a positional relationship between the handle 91 and the link shaft 90. The longitudinal alignment reference plates 39 of the present embodiment are not configured to be movable between the third positions and the fourth positions described in the third embodiment. That is, the longitudinal alignment reference plates 39 are fixed to the holders 108 and a support member of the longitudinal movement unit 56.

Also in the present embodiment, the distal ends 39*b* of the longitudinal alignment reference plates 39 are positioned below the supporting surface 32*s* of the intermediate supporting plate 32 when the upper unit 101 is at the abutting position serving as a first position. In addition, when the upper unit 101 is at the separation position serving as a second position, the distal ends 39*b* of the longitudinal alignment reference plates 39 are separated upward from the supporting surface 32*s* of the intermediate supporting plate 32. In other words, in the case where the upper unit is at the first position, the lower ends of the alignment members are positioned below the sheet supporting surface of the supporting portion, and in the case where the upper unit is at the second position, the lower ends of the alignment members are separated upward from the sheet supporting surface of the supporting portion.

As illustrated in FIGS. 14B and 14D, the handle 91 serving as an operation portion is detachably engaged with the link shaft 90 serving as an engaged portion provided on the upper unit 101. In the present embodiment, the shape of an engaging portion 91*a* of the handle 91 that engages with the link shaft 90 has a recess shape opening in a tangent direction of the arcuate shape of the handle rail 92, that is, in a pivot direction for opening the upper unit 101. In other words, the operation portion has a recess portion that receives the engaged portion and that is opening in a direction of movement of the engaged portion when the upper unit moves from the first position to the second position. To be noted, as a modification example, a configuration in which the link shaft 90 has a recess portion opening in an opposite direction to the opening direction of the recess portion described above and the handle 91 has a shaft portion that fits in this recess portion may be employed.

When the user grips the handle 91 and moves the upper unit 101 away from the lower unit 102 to the position illustrated in FIG. 14A from the state illustrated in FIG. 2 in which the upper unit 101 and the lower unit 102 are in contact with each other, the engagement between the handle 91 and the link shaft 90 is maintained. That is, a force to rotate the upper unit in the counterclockwise direction in FIG. 14A acts due to its own weight, and therefore the handle 91, the link shaft 90, and the upper unit 101 integrally pivot in the clockwise direction in FIG. 14A. In addition, also when the user grips the handle 91 and moves the upper unit 101 from the separation position serving as a second position illustrated in FIG. 14A in the counterclockwise direction in FIG. 14A to close the upper unit 101, the handle 91 moves with the upper unit 101 substantially integrally. In this case, although the handle 91 may move slightly ahead of the upper unit 101, the upper unit 101 moves following the handle 91 due to its own weight.

In contrast, the following operation is performed in the case where the jammed sheet S4 is still on the supporting surface 32*s*. When the upper unit 101 is moved in the direction to close the upper unit 101 from the state in which the upper unit 101 is separated from the lower unit 102 as illustrated in FIG. 14A, the distal ends 39*b* of the longitudinal alignment reference plates 39 abut the jammed sheet S4 when the upper unit 101 is at a certain position illustrated in FIG. 14C. Even if the handle 91 is moved further in approximately the counterclockwise direction in FIG. 14C, since the upper unit receives the reaction force from the jammed sheet S4 via the longitudinal alignment reference plates 39 and thus the movement thereof is restricted, the upper unit 101 does not move further, and only the handle 91 moves. At this time, the handle 91 and the link shaft 90 are detached or separated from each other as illustrated in FIG. 14D. In other words, in the case where the operation portion is operated toward the first position in a state in which the upper unit is at the second position, when the alignment members abut the obstacle present on the supporting portion, the operation portion is detached from the upper unit, and the upper unit remains at a position between the first position and the second position.

According to the configuration of the present embodiment, even in the case where the user attempts to move the upper unit 101 from the separation position to the abutting position in the state in which the jammed sheet S4 is still on the supporting surface 32*s*, a strong shearing force acting on the jammed sheet S4 derived from the operation force from the user can be suppressed. As a result of this, the possibility of the longitudinal alignment reference plates 39 or the other members get damaged by receiving the reaction force from the jammed sheet S4 can be reduced.

Other Embodiments

Although a sheet alignment apparatus provided in the intermediate supporting portion 42 serving as a processing portion of the post-processing apparatus 4 capable of performing a binding process on sheets have been described, the sheet aligning process of the present disclosure can be incorporated in any apparatus that handles sheets. For example, the present technique may be applied to a sheet alignment apparatus provided as a part of an image forming system or an image forming apparatus in which the intermediate supporting portion 42 is disposed in one casing together with the image forming portion 1B.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2020-117003, filed on Jul. 7, 2020, and 2021-73269, filed on Apr. 23, 2021, which are hereby incorporated by reference herein in their entirety.

What is claimed is:

1. A sheet alignment apparatus comprising:

a supporting portion configured to support a sheet;

a first alignment member configured to abut an end portion in a first direction of the sheet supported by the supporting portion and align a position of the sheet in the first direction;

a first moving unit configured to move the first alignment member in the first direction;

a second alignment member configured to abut an end portion in a second direction of the sheet supported by the supporting portion and align a position of the sheet in the second direction, the second direction being perpendicular to the first direction; and a second moving unit configured to move the second alignment member in the second direction, wherein the first moving unit is disposed below the supporting portion, wherein the second moving unit is disposed above the supporting portion, and wherein, as viewed in a third direction perpendicular to the first direction and the second direction, a movement region in which the first alignment member is moved on the supporting portion by the first moving unit intersects with a movement region in which the second alignment member is moved on the supporting portion by the second moving unit.

2. The sheet alignment apparatus according to claim 1, further comprising an opposing member provided above the supporting portion to oppose the supporting portion such that a supporting space in which the sheet is supported is defined between the supporting portion and the opposing member, wherein a first hole extending in the first direction and a first groove extending in the second direction are provided in the supporting portion, wherein a second groove extending in the first direction and a second hole extending in the second direction are provided in the opposing member, wherein the first alignment member extends to a region inside the second groove through the first hole, and wherein the second alignment member extends to a region inside the first groove through the second hole.

3. The sheet alignment apparatus according to claim 1, wherein the first alignment member is configured to move in the first direction to align the sheet in a state in which the second alignment member is not moving and is in a position corresponding to a length in the second direction of the sheet supported by the supporting portion, the position being included in a plurality of preset positions, and wherein the first alignment member is disposed such that a position where the first alignment member abuts the sheet is different from all of the plurality of preset positions.

4. The sheet alignment apparatus according to claim 1, wherein the first alignment member comprises a plurality of first abutting portions that are provided at a plurality of positions in the second direction and configured to abut the sheet, and wherein the plurality of first abutting portions are disposed to abut an end portion of the sheet at at least two positions for each of a plurality of sheet sizes having different length in the second direction, a center of gravity of the sheet being positioned between the two positions in the second direction.

5. The sheet alignment apparatus according to claim 1, wherein the second alignment member comprises a plurality of second abutting portions that are provided at a plurality of positions in the first direction and configured to abut the sheet, and wherein the plurality of second abutting portions are disposed to abut an end portion of the sheet at at least two positions for each of a plurality of sheet sizes having different length in the first direction, a center of gravity of the sheet being positioned between the two positions in the first direction.

6. The sheet alignment apparatus according to claim 1, wherein the second alignment member is configured to be driven by the second moving unit and perform a discharge operation of pushing out the sheet from the supporting portion in the second direction.

7. The sheet alignment apparatus according to claim 6, further comprising a roller pair disposed downstream of the supporting portion in a discharge direction of the sheet in the discharge operation and configured to nip and convey the sheet pushed out from the supporting portion, wherein the second alignment member is movable in the discharge direction until a downstream end of a sheet having a smallest length in the second direction among sheet sizes capable of being aligned on the supporting portion reaches a nip position of the roller pair.

8. The sheet alignment apparatus according to claim 1, further comprising a first direction reference member serving as a reference for the position of the sheet in the first direction, wherein the first alignment member is configured to abut a first end portion of the sheet on the supporting portion in the first direction and press the sheet such that a second end portion of the sheet in the first direction abuts the first direction reference member.

9. The sheet alignment apparatus according to claim 1, further comprising a moving member configured to abut an upper surface of the sheet on the supporting portion and move the sheet such that an end portion of the sheet in the second direction abuts the second alignment member, wherein the second alignment member serves as a reference of the position of the sheet in the second direction.

10. The sheet alignment apparatus according to claim 9, wherein the moving member is moved in the second direction together with the second alignment member by the second moving unit while maintaining a certain distance between the moving member and the second alignment member in the second direction.

11. A sheet processing apparatus comprising:

the sheet alignment apparatus according to claim 1; and a processing unit configured to process the sheet aligned by the sheet alignment apparatus.

12. An image forming system comprising:

an image forming unit configured to form an image on a sheet; and the sheet processing apparatus according to claim 11 configured to process the sheet on which the image has been formed by the image forming unit.

13. A sheet alignment apparatus comprising:

a supporting portion configured to support a sheet;

an opposing member provided above the supporting portion to oppose the supporting portion such that a supporting space in which the sheet is supported is defined between the supporting portion and the opposing member, a first alignment member configured to abut an end portion in a first direction of the sheet supported by the supporting portion and align a position of the sheet in the first direction;

a first moving unit configured to move the first alignment member in the first direction;

a second alignment member configured to abut an end portion in a second direction of the sheet supported by the supporting portion and align a position of the sheet in the second direction, the second direction being perpendicular to the first direction; and a second moving unit configured to move the second alignment member in the second direction, wherein the first moving unit is disposed below the supporting portion, wherein the second moving unit is disposed above the supporting portion, wherein a first hole extending in the first direction and a first groove extending in the second direction are provided in the supporting portion, wherein a second groove extending in the first direction and a second hole extending in the second direction are provided in the opposing member, wherein the first alignment member extends to a region inside the second groove through the first hole, and wherein the second alignment member extends to a region inside the first groove through the second hole.

14. The sheet alignment apparatus according to claim 1, further comprising a roller configured to abut an upper surface of the sheet on the supporting portion and move the sheet such that the end portion of the sheet in the second direction abuts the second alignment member, wherein the second alignment member serves as a reference of the position of the sheet in the second direction.

* * * * *